US008287354B2

(12) United States Patent
Gail et al.

(10) Patent No.: US 8,287,354 B2
(45) **Date of Patent: *Oct. 16, 2012**

(54) DRAW BINGO

(75) Inventors: Ted Gail, Sparks, NV (US); Larry Hollibaugh, Reno, NV (US); Bryan Wolf, Reno, NV (US)

(73) Assignee: IGT, Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/246,142

(22) Filed: Sep. 27, 2011

(65) Prior Publication Data

US 2012/0028696 A1 Feb. 2, 2012

Related U.S. Application Data

(63) Continuation of application No. 10/925,710, filed on Aug. 24, 2004, now Pat. No. 8,057,292.

(60) Provisional application No. 60/592,410, filed on Jul. 30, 2004, provisional application No. 60/503,161, filed on Sep. 15, 2003.

(51) Int. Cl.
*A63F 3/06* (2006.01)

(52) U.S. Cl. ..... 463/19

(58) Field of Classification Search ..... 463/19
See application file for complete search history.

(56) References Cited

U.S. PATENT DOCUMENTS 1,723,377 A 8/1929 Salomon
3,618,952 A 11/1971 Tallarida
3,628,259 A 12/1971 Kahn
4,156,976 A 6/1979 Mikun
4,157,829 A 6/1979 Goldman et al.
4,332,389 A 6/1982 Loyd, Jr. et al.
4,335,809 A 6/1982 Wain
4,339,798 A 7/1982 Hedges et al.
4,364,567 A 12/1982 Goott
4,365,810 A 12/1982 Richardson
4,371,169 A 2/1983 Compton
4,373,726 A 2/1983 Churchill et al.
4,448,419 A 5/1984 Telnaes (Continued)

FOREIGN PATENT DOCUMENTS

EP 0 199 690 10/1986

(Continued)

OTHER PUBLICATIONS

U.S. Appl. No. 13/347,591, filed Jan. 10, 2012, Hollibaugh et al.

(Continued)

*Primary Examiner* — Dmitry Suhol
*Assistant Examiner* — Carl V Larsen
(74) *Attorney, Agent, or Firm* — Weaver Austin Villeneuve & Sampson LLP

(57) ABSTRACT

The present invention provides methods and devices for providing a bingo game having aspects of a poker game on a network of gaming machines. Some implementations include a bingo card display in which areas of a bingo card correspond with playing cards. Some such implementations provide first phase of a bingo game that is concluded when a player daubs a game-ending pattern of a bingo card and a second phase wherein players may establish interim wins by daubing other patterns that correspond to poker hands. In some implementations, only the highest-ranking interim win results in a payout. Preferred implementations provide games with easily recognizable bingo play and payout probabilities similar to existing bingo games.

15 Claims, 13 Drawing Sheets

U.S. PATENT DOCUMENTS

| | | | | |
|---|---|---|---|---|
| 4,455,025 | A | | 6/1984 | Itkis |
| 4,467,424 | A | | 8/1984 | Hedges et al. |
| 4,494,197 | A | | 1/1985 | Troy et al. |
| 4,560,171 | A | | 12/1985 | Anthony |
| 4,582,324 | A | | 4/1986 | Koza et al. |
| 4,624,462 | A | | 11/1986 | Itkis |
| 4,652,998 | A | | 3/1987 | Koza et al. |
| 4,669,730 | A | | 6/1987 | Small |
| 4,689,742 | A | | 8/1987 | Troy et al. |
| 4,743,022 | A | | 5/1988 | Wood |
| 4,760,527 | A | * | 7/1988 | Sidley ..... 463/13 |
| 4,798,387 | A | | 1/1989 | Richardson |
| 4,805,907 | A | | 2/1989 | Hagiwara |
| 4,815,741 | A | | 3/1989 | Small |
| 4,817,951 | A | | 4/1989 | Crouch et al. |
| 4,842,278 | A | | 6/1989 | Markowicz |
| 4,848,771 | A | | 7/1989 | Richardson |
| 4,856,787 | A | | 8/1989 | Itkis |
| 4,982,337 | A | | 1/1991 | Burr et al. |
| 5,007,649 | A | | 4/1991 | Richardson |
| 5,011,159 | A | | 4/1991 | Fortunato et al. |
| 5,042,809 | A | | 8/1991 | Richardson |
| 5,078,403 | A | | 1/1992 | Chernowski, Jr. |
| 5,092,598 | A | | 3/1992 | Kamille |
| 5,100,137 | A | | 3/1992 | Fulton |
| 5,100,139 | A | | 3/1992 | Di Bella |
| 5,145,182 | A | | 9/1992 | Swift et al. |
| 5,158,293 | A | | 10/1992 | Mullins |
| 5,167,413 | A | | 12/1992 | Fulton |
| 5,224,706 | A | | 7/1993 | Bridgeman et al. |
| 5,242,163 | A | | 9/1993 | Fulton |
| 5,265,874 | A | | 11/1993 | Dickinson et al. |
| 5,275,400 | A | | 1/1994 | Weingardt et al. |
| 5,276,312 | A | | 1/1994 | McCarthy |
| 5,282,620 | A | | 2/1994 | Keesee |
| 5,294,120 | A | | 3/1994 | Schultz |
| 5,294,128 | A | | 3/1994 | Marquez |
| 5,297,802 | A | | 3/1994 | Pocock et al. |
| 5,324,035 | A | | 6/1994 | Morris et al. |
| 5,351,970 | A | | 10/1994 | Fioretti |
| 5,356,140 | A | | 10/1994 | Dabrowski et al. |
| 5,393,057 | A | | 2/1995 | Marnell, II |
| 5,398,932 | A | | 3/1995 | Eberhardt et al. |
| 5,401,023 | A | | 3/1995 | Wood |
| 5,407,199 | A | | 4/1995 | Gumina |
| 5,482,289 | A | | 1/1996 | Weingardt |
| 5,489,101 | A | | 2/1996 | Moody |
| 5,511,781 | A | | 4/1996 | Wood et al. |
| 5,531,448 | A | | 7/1996 | Moody |
| 5,542,669 | A | | 8/1996 | Charron et al. |
| 5,570,885 | A | | 11/1996 | Ornstein |
| 5,584,486 | A | | 12/1996 | Franklin |
| 5,588,913 | A | | 12/1996 | Hecht |
| 5,593,161 | A | | 1/1997 | Boylan et al. |
| 5,601,287 | A | | 2/1997 | Lundin |
| 5,628,684 | A | | 5/1997 | Bouedec |
| 5,630,754 | A | | 5/1997 | Rebane |
| 5,639,088 | A | | 6/1997 | Schneider et al. |
| 5,674,128 | A | | 10/1997 | Holch et al. |
| 5,678,001 | A | | 10/1997 | Nagel et al. |
| 5,707,285 | A | | 1/1998 | Place et al. |
| 5,709,603 | A | | 1/1998 | Kaye |
| 5,711,715 | A | | 1/1998 | Ringo et al. |
| 5,718,431 | A | | 2/1998 | Ornstein |
| 5,722,891 | A | | 3/1998 | Inoue |
| 5,732,950 | A | | 3/1998 | Moody |
| 5,755,619 | A | | 5/1998 | Matsumoto et al. |
| 5,762,552 | A | | 6/1998 | Vuong et al. |
| 5,775,692 | A | | 7/1998 | Watts et al. |
| 5,779,545 | A | | 7/1998 | Berg et al. |
| 5,791,987 | A | | 8/1998 | Chen et al. |
| 5,800,269 | A | | 9/1998 | Holch et al. |
| 5,816,916 | A | | 10/1998 | Moody |
| 5,823,873 | A | | 10/1998 | Moody |
| 5,823,874 | A | | 10/1998 | Adams |
| 5,833,537 | A | | 11/1998 | Barrie |
| 5,833,540 | A | | 11/1998 | Miodunski et al. |
| 5,848,932 | A | | 12/1998 | Adams |
| 5,851,011 | A | | 12/1998 | Lott |
| 5,868,619 | A | | 2/1999 | Wood et al. |
| 5,871,398 | A | | 2/1999 | Schneier et al. |
| 5,882,258 | A | | 3/1999 | Kelly et al. |
| 5,882,260 | A | | 3/1999 | Marks et al. |
| 5,944,606 | A | | 8/1999 | Gerow |
| 5,949,042 | A | | 9/1999 | Dietz et al. |
| 5,951,396 | A | | 9/1999 | Tawil |
| 5,954,335 | A | | 9/1999 | Moody |
| 5,954,582 | A | | 9/1999 | Zach |
| 5,976,016 | A | | 11/1999 | Moody et al. |
| 5,984,310 | A | | 11/1999 | English |
| 5,984,779 | A | | 11/1999 | Bridgeman et al. |
| 6,007,066 | A | | 12/1999 | Moody |
| 6,007,424 | A | | 12/1999 | Evers et al. |
| 6,012,720 | A | | 1/2000 | Webb |
| 6,012,981 | A | | 1/2000 | Fujioka et al. |
| 6,012,984 | A | | 1/2000 | Roseman |
| 6,017,032 | A | | 1/2000 | Grippo et al. |
| 6,024,640 | A | | 2/2000 | Walker et al. |
| 6,062,980 | A | | 5/2000 | Luciano |
| 6,079,711 | A | | 6/2000 | Wei et al. |
| 6,089,982 | A | | 7/2000 | Holch et al. |
| 6,093,100 | A | | 7/2000 | Singer et al. |
| 6,098,985 | A | | 8/2000 | Moody |
| 6,120,378 | A | | 9/2000 | Moody et al. |
| 6,126,541 | A | | 10/2000 | Fuchs |
| 6,126,542 | A | | 10/2000 | Fier |
| 6,132,311 | A | | 10/2000 | Williams |
| 6,146,271 | A | | 11/2000 | Kadlic |
| 6,146,272 | A | | 11/2000 | Walker et al. |
| 6,149,156 | A | | 11/2000 | Feola |
| 6,149,521 | A | | 11/2000 | Sanduski |
| 6,159,095 | A | | 12/2000 | Frohm et al. |
| 6,168,521 | B1 | | 1/2001 | Luciano et al. |
| 6,174,233 | B1 | | 1/2001 | Sunaga et al. |
| 6,183,361 | B1 | | 2/2001 | Cummings et al. |
| 6,190,255 | B1 | | 2/2001 | Thomas et al. |
| 6,196,547 | B1 | | 3/2001 | Pascal et al. |
| 6,203,429 | B1 | | 3/2001 | Demar et al. |
| 6,210,275 | B1 | | 4/2001 | Olsen |
| 6,210,276 | B1 | | 4/2001 | Mullins |
| 6,217,448 | B1 | | 4/2001 | Olsen |
| 6,220,961 | B1 | | 4/2001 | Keane et al. |
| 6,241,606 | B1 | | 6/2001 | Riendeau et al. |
| 6,254,480 | B1 | | 7/2001 | Zach |
| 6,257,980 | B1 | | 7/2001 | Santini, Jr. |
| 6,273,424 | B1 | | 8/2001 | Breeding |
| 6,273,820 | B1 | | 8/2001 | Haste, III |
| 6,280,325 | B1 | | 8/2001 | Fisk |
| 6,280,328 | B1 | | 8/2001 | Holch et al. |
| 6,309,298 | B1 | | 10/2001 | Gerow |
| 6,312,334 | B1 | | 11/2001 | Yoseloff |
| 6,325,716 | B1 | | 12/2001 | Walker et al. |
| 6,358,151 | B1 | | 3/2002 | Enzminger et al. |
| 6,368,218 | B2 | | 4/2002 | Angell, Jr. |
| 6,394,456 | B1 | | 5/2002 | Long |
| 6,398,645 | B1 | | 6/2002 | Yoseloff |
| 6,402,614 | B1 | | 6/2002 | Schneier et al. |
| 6,419,583 | B1 | | 7/2002 | Crumby et al. |
| 6,425,824 | B1 | | 7/2002 | Baerlocher et al. |
| 6,450,885 | B2 | | 9/2002 | Schneier et al. |
| 6,454,648 | B1 | | 9/2002 | Kelly et al. |
| RE37,885 | E | | 10/2002 | Acres et al. |
| 6,475,086 | B2 | | 11/2002 | Zach |
| 6,494,454 | B2 | | 12/2002 | Adams |
| 6,508,711 | B1 | | 1/2003 | Ono |
| 6,511,068 | B1 | | 1/2003 | Sklansky et al. |
| 6,524,184 | B1 | | 2/2003 | Lind et al. |
| 6,524,185 | B2 | | 2/2003 | Lind |
| 6,527,638 | B1 | | 3/2003 | Walker et al. |
| 6,533,664 | B1 | | 3/2003 | Crumby |
| 6,537,150 | B1 | | 3/2003 | Luciano et al. |
| 6,554,283 | B2 | | 4/2003 | Vancura et al. |
| 6,568,677 | B2 | | 5/2003 | Brenner |
| 6,569,017 | B2 | | 5/2003 | Enzminger et al. |
| 6,575,467 | B1 | | 6/2003 | Kal |
| 6,585,266 | B1 | | 7/2003 | Lovell |
| 6,585,590 | B2 | | 7/2003 | Malone |

| | | | | |
|---|---|---|---|---|
| 6,599,187 | B2 | 7/2003 | Gerow | |
| 6,607,439 | B2 | 8/2003 | Schneier et al. | |
| 6,609,974 | B2 | 8/2003 | Mead et al. | |
| 6,612,927 | B1 | 9/2003 | Slomiany et al. | |
| 6,619,660 | B2 | 9/2003 | Schaefer et al. | |
| 6,656,044 | B1 | 12/2003 | Lewis | |
| 6,676,126 | B1 | 1/2004 | Walker et al. | |
| 6,685,562 | B1 | 2/2004 | Rantanen | |
| 6,695,695 | B2 | 2/2004 | Angel | |
| 6,722,655 | B1 | 4/2004 | Camero | |
| 6,729,621 | B2 | 5/2004 | Moody | |
| 6,729,961 | B1 | 5/2004 | Millerschone | |
| 6,733,385 | B1 | 5/2004 | Enzminger et al. | |
| 6,739,970 | B2 | 5/2004 | Luciano | |
| 6,743,102 | B1 | 6/2004 | Fiechter et al. | |
| 6,749,500 | B1 | 6/2004 | Nelson et al. | |
| 6,780,108 | B1 | 8/2004 | Luciano et al. | |
| 6,802,776 | B2 | 10/2004 | Lind et al. | |
| 6,802,778 | B1 | 10/2004 | Lemay et al. | |
| 6,805,629 | B1 | 10/2004 | Weiss | |
| 6,840,858 | B2 | 1/2005 | Adams | |
| 6,874,784 | B1 | 4/2005 | Promutico et al. | |
| 6,918,831 | B2 | 7/2005 | Nguyen et al. | |
| 6,923,719 | B2 | 8/2005 | Wolf | |
| 6,932,707 | B2 | 8/2005 | Duhamel | |
| 7,059,966 | B2 | 6/2006 | Luciano, Jr. et al. | |
| 7,128,647 | B2 | 10/2006 | Muir | |
| 7,481,707 | B1 | 1/2009 | Luciano et al. | |
| 7,955,170 | B2 | 6/2011 | Gail et al. | |
| 8,047,913 | B2 * | 11/2011 | Moshal | 463/25 |
| 8,057,292 | B2 * | 11/2011 | Gail et al. | 463/19 |
| 8,123,606 | B2 | 2/2012 | Hollibaugh et al. | |
| 2001/0036855 | A1 | 11/2001 | DeFrees-Parrott et al. | |
| 2001/0046892 | A1 | 11/2001 | Santini, Jr. | |
| 2002/0010013 | A1 | 1/2002 | Walker et al. | |
| 2002/0094869 | A1 | 7/2002 | Harkham | |
| 2002/0098882 | A1 | 7/2002 | Lind et al. | |
| 2002/0098883 | A1 | 7/2002 | Packes, Jr. et al. | |
| 2002/0111207 | A1 | 8/2002 | Lind et al. | |
| 2002/0113369 | A1 * | 8/2002 | Weingardt | 273/269 |
| 2002/0132661 | A1 | 9/2002 | Lind et al. | |
| 2002/0155877 | A1 | 10/2002 | Enzminger et al. | |
| 2002/0196342 | A1 | 12/2002 | Walker et al. | |
| 2003/0060257 | A1 | 3/2003 | Katz et al. | |
| 2003/0060261 | A1 | 3/2003 | Katz et al. | |
| 2003/0060276 | A1 | 3/2003 | Walker et al. | |
| 2003/0098544 | A1 | 5/2003 | Tarantino | |
| 2003/0125101 | A1 | 7/2003 | Campo | |
| 2003/0127793 | A1 | 7/2003 | Adams | |
| 2003/0144050 | A1 | 7/2003 | Keaton et al. | |
| 2003/0162577 | A1 | 8/2003 | Hamud | |
| 2003/0181231 | A1 | 9/2003 | Vancura et al. | |
| 2003/0190943 | A1 | 10/2003 | Walker et al. | |
| 2003/0216165 | A1 | 11/2003 | Singer et al. | |
| 2003/0228899 | A1 | 12/2003 | Evans | |
| 2003/0236116 | A1 | 12/2003 | Marks et al. | |
| 2004/0009806 | A1 | 1/2004 | Odom | |
| 2004/0023706 | A1 | 2/2004 | Hunter et al. | |
| 2004/0036212 | A1 | 2/2004 | Walker et al. | |
| 2004/0038723 | A1 | 2/2004 | Schneier et al. | |
| 2004/0053675 | A1 | 3/2004 | Nguyen et al. | |
| 2004/0072604 | A1 | 4/2004 | Toyoda | |
| 2004/0072605 | A1 | 4/2004 | Toyoda | |
| 2004/0077400 | A1 | 4/2004 | Marshall | |
| 2004/0132523 | A1 | 7/2004 | Staw | |
| 2004/0142747 | A1 | 7/2004 | Pryzby | |
| 2004/0152503 | A1 | 8/2004 | Lind et al. | |
| 2004/0152505 | A1 | 8/2004 | Herrmann et al. | |
| 2004/0152508 | A1 | 8/2004 | Lind et al. | |
| 2004/0166920 | A1 | 8/2004 | Boyd et al. | |
| 2004/0185932 | A1 | 9/2004 | Lombardo | |
| 2004/0219969 | A1 | 11/2004 | Casey et al. | |
| 2004/0235542 | A1 | 11/2004 | Stronach et al. | |
| 2004/0235555 | A1 | 11/2004 | Yarbrough et al. | |
| 2004/0259621 | A1 | 12/2004 | Pfeiffer et al. | |
| 2004/0266507 | A1 | 12/2004 | Cooper | |
| 2005/0026665 | A1 | 2/2005 | Gerrard et al. | |
| 2005/0037832 | A1 | 2/2005 | Cannon | |
| 2005/0037834 | A1 | 2/2005 | Stern et al. | |
| 2005/0054426 | A1 | 3/2005 | Toyoda | |
| 2005/0059449 | A1 | 3/2005 | Yarbrough | |
| 2005/0059469 | A1 | 3/2005 | Gail et al. | |
| 2005/0059471 | A1 | 3/2005 | Cannon | |
| 2005/0096130 | A1 | 5/2005 | Mullins | |
| 2005/0098944 | A1 | 5/2005 | Brandstetter | |
| 2005/0101387 | A1 | 5/2005 | Wolf | |
| 2005/0167916 | A1 | 8/2005 | Banyai | |
| 2005/0221883 | A1 | 10/2005 | Lind et al. | |
| 2005/0233798 | A1 * | 10/2005 | Van Asdale | 463/19 |
| 2006/0025189 | A1 | 2/2006 | Hollibaugh et al. | |
| 2006/0025198 | A1 | 2/2006 | Gail et al. | |
| 2006/0025199 | A1 | 2/2006 | Harkins et al. | |
| 2006/0217176 | A1 | 9/2006 | Walker et al. | |
| 2007/0093286 | A1 | 4/2007 | Marshall | |
| 2007/0135211 | A1 | 6/2007 | Block et al. | |
| 2007/0142113 | A1 | 6/2007 | Walker et al. | |
| 2007/0207850 | A1 | 9/2007 | Darrah et al. | |
| 2008/0070663 | A1 | 3/2008 | Losilevsky | |
| 2011/0212759 | A1 | 9/2011 | Gail et al. | |
| 2012/0108310 | A1 | 5/2012 | Hollibaugh et al. | |

FOREIGN PATENT DOCUMENTS

| | | | |
|---|---|---|---|
| EP | 0 769 769 | | 4/1997 |
| EP | 1 302 914 | | 4/2003 |
| EP | 1 341 135 | | 9/2003 |
| EP | 1 343 125 | | 9/2003 |
| JP | 2001-161888 | A | 6/2001 |
| JP | 2003-225461 | A | 8/2003 |
| JP | 2004-130122 | A | 4/2004 |
| WO | WO 96/18174 | | 6/1996 |
| WO | WO 01/99067 | | 12/2001 |
| WO | WO 03/063019 | | 7/2003 |
| WO | WO 2004/095383 | | 11/2004 |

OTHER PUBLICATIONS

US Office Action dated Jul. 2, 2009 issued in U.S. Appl. No. 10/925,710.

US Office Action Final dated Feb. 28, 2011 issued in U.S. Appl. No. 10/925,710.

US Notice of Allowance dated Jun. 27, 2011 issued in U.S. Appl. No. 10/925,710.

US Office Action (Response to Rule 312 Communication) dated Jul. 27, 2011 issued in U.S. Appl. No. 10/925,710.

US Office Action dated Dec. 2, 2009 issued in U.S. Appl. No. 11/149,828.

US Office Action dated May 27, 2010 issued in U.S. Appl. No. 11/149,828.

US Office Action Final dated Oct. 26, 2010 issued in U.S. Appl. No. 11/149,828.

US Office Action (Notice of Panel Decision from Pre-Appeal Brief Review) dated Mar. 3, 2011 issued in U.S. Appl. No. 11/149,828.

US Office Action dated Jun. 27, 2007 issued in U.S. Appl. No. 11/026,860.

US Office Action dated Dec. 21, 2007 issued in U.S. Appl. No. 11/026,860.

US Office Action dated Jul. 9, 2008 issued in U.S. Appl. No. 11/026,860.

US Office Action dated Apr. 8, 2009 issued in U.S. Appl. No. 11/026,860.

U.S. Office Action dated Apr. 29, 2008 issued in U.S. Appl. No. 11/031,048.

US Final Office Action dated Nov. 12, 2008 issued in U.S. Appl. No. 11/031,048.

US Office Action dated Jun. 12, 2009 issued in U.S. Appl. No. 11/031,048.

US Office Action dated Apr. 26, 2010 issued in U.S. Appl. No. 11/031,048.

US Final Office Action dated Dec. 10, 2010 issued in U.S. Appl. No. 11/031,048.

US Office Action (Notice of Panel Decision from Pre-Appeal Brief Review) dated May 9, 2011 issued in U.S. Appl. No. 11/031,048.

US Office Action dated May 31, 2011 issued in U.S. Appl. No. 11/031,048.

US Notice of Allowance and Examiner Interview Summary dated Oct. 11, 2011 issued in U.S. Appl. No. 11/031,048.
US Office Action dated Mar. 17, 2008 issued in U.S. Appl. No. 10/937,227.
US Office Action dated Nov. 17, 2008 issued in U.S. Appl. No. 10/937,227.
US Final Office Action dated Jun. 17, 2009 issued in U.S. Appl. No. 10/937,227.
US Office Action dated Jan. 12, 2010 issued in U.S. Appl. No. 10/937,227.
US Office Action dated Jul. 13, 2010 issued in U.S. Appl. No. 10/937,227.
US Office Action dated Sep. 12, 2007 issued in U.S. Appl. No. 10/969,127.
US Final Office Action dated Apr. 3, 2008 issued in U.S. Appl. No. 10/969,127.
US Office Action dated Sep. 16, 2008 issued in U.S. Appl. No. 10/969,127.
US Final Office Action dated Apr. 3, 2009 issued in U.S. Appl. No. 10/969,127.
US Pre-Brief Appeal Conference Decision dated Aug. 21, 2009 issued in U.S. Appl. No. 10/969,127.
US Office Action dated Dec. 22, 2009 issued in U.S. Appl. No. 10/969,127.
US Final Office Action dated Jul. 2, 2010 issued in U.S. Appl. No. 10/969,127.
US Notice of Allowance and Examiner's Interview Summary dated Mar. 28, 2011 issued in U.S. Appl. No. 10/969,127.
Third Party Submission for U.S. Appl. No. 13/092,675 dated Oct. 31, 2011.
US Restriction Requirement dated Jun. 8, 2007 issued in U.S. Appl. No. 10/931,673.
US Office Action dated Aug. 20, 2007 issued in U.S. Appl. No. 10/931,673.
US Office Action dated Sep. 13, 2007 issued in U.S. Appl. No. 10/941,606.
US Office Action dated Jul. 3, 2007 issued in U.S. Appl. No. 10/755,982.
US Office Action dated Sep. 21, 2007 issued in U.S. Appl. No. 10/756,429.
Ep Examiner's Communication dated Jul. 3, 2006 issued in EP App No. 04783935.2.
Ep Examination Report dated Oct. 22, 2007 issued in EP No. 04 788 725.2.
Ep Examiner's Communication dated Oct. 25, 2006 issued in EP App No. 04784069.9.
PCT International Search Report and Written Opinion dated Feb. 3, 2005 issued in PCT/US2004/030285.
PCT International Search Report and Written Opinion dated Jan. 24, 2005 issued in PCT/US2004/030093.
EP Examiner's Communication dated Jul. 3, 2006 issued in EP App No. 04784071.5.
PCT International Search Report and Written Opinion dated Feb. 3, 2005 issued in PCT/US2004/029839.
PCT International Search Report and Written Opinion dated Nov. 11, 2005 issued in PCT/US2004/029912.
PCT International Search Report and Written Opinion dated Jul. 4, 2007 issued in PCT/US2006/047714.
PCT International Search Report dated Jun. 6, 2007 issued in PCT/US2006/048264.
PCT Written Opinion dated Jun. 6, 2007 issued in PCT/US2006/048264.
PCT International Search Report and Written Opinion dated Jan. 24, 2005 issued in PCT/US2004/029906.
PCT International Search Report and Written Opinion dated Jan. 25, 2005 issued in PCT/US2004/029913.
Aho et al., (1983) "Data Structures and Algorithms", *Addison-Wesley*, 13-16, 56-57, 260-261 and 367.
Diamonopoly Advertisement by International Gamco, Inc. (2002); Electronic Tabs Advertisement by 21st Century Gaming (2002).
Lucky Times California Lottery Newsletter published 1996; Instant Winner Advertisement by Williams/WMS Gaming, published prior to 2002.
Play it again Advertisement by International Gamco, Inc. (2000).
Encyclopedia > Suit (cards) NationMaster.com [online], [retrieved on Apr. 7, 2010]. Retrieved from the Internet <URL:http:www.statemaster.com/encyclopedia/Suit-(cards)>, 9 pages.
Third Party Submission for U.S. Appl. No. 13/347,591 dated Jul. 2, 2012.

* cited by examiner

DRAW BINGO

CROSS-REFERENCE TO RELATED APPLICATIONS

This application is a continuation of and claims priority to co-pending U.S. patent application Ser. No. 10/925,710, entitled "Draw Bingo" and filed Aug. 24, 2004, which claims priority to U.S. Provisional Patent Application No. 60/592,410, entitled "Draw Bingo" and filed Jul. 30, 2004, and U.S. Provisional Patent Application No. 60/503,161, entitled "Gaming Network with Multi-Player Bingo Game, and filed Sep. 15, 2003, all of which are hereby incorporated by reference in their entirety and for all purposes.

BACKGROUND OF THE INVENTION

The present disclosure relates to gaming networks and, more particularly, to a gaming network providing a multi-player bingo game.

Gaming in the United States is divided into Class I, Class II and Class III games. Class I gaming includes social games played for minimal prizes, or traditional ceremonial games. Class II gaming includes bingo and bingo-like games. Bingo includes games played for prizes, including monetary prizes, with cards bearing numbers or other designations in which the holder of the cards covers such numbers or designations when objects, similarly numbered or designated, are drawn or electronically determined, and in which the game is won by the first person covering a previously designated arrangement of numbers or designations on such cards. Such an arrangement will sometimes be referred to herein as a "game-winning pattern" or a "game-ending pattern." Class II gaming may also include pull tab games if played in the same location as bingo games, lotto, punch boards, tip jars, instant bingo, and other games similar to bingo. Class III gaming includes any game that is not a Class I or Class II game, such as games of chance typically offered in non-Indian, state-regulated casinos.

Two basic forms of bingo exist. In traditional bingo, the players purchase cards after which a draw takes place. The first player to achieve a designated pattern wins. In one type of bingo game known as Bonanza Bingo, the draw for the game takes place before the players know the arrangements on their bingo cards. After the draw occurs, the players may purchase cards and compare the arrangements on the cards to the drawn numbers to determine whether predetermined patterns are matched. Play continues in Bonanza Bingo until at least one of the players matches a designated game-winning pattern. Bonanza Bingo may also encompass bingo variations wherein a partial draw is conducted for some numbers (generally fewer than the number of balls expected to be necessary to win the game) prior to selling the bingo cards. After the bingo cards are sold, additional numbers are drawn until there is a winner.

As indicated above, a bingo game is played until at least one player covers a predetermined game-winning pattern on the player's bingo card. The game may also include interim winners of prizes based on matching predetermined interim patterns on the bingo card using the same ball draw. The interim pattern wins do not terminate the bingo game. For interim pattern awards, players covering certain interim patterns may receive an additional award as the game continues. Some exceptional bingo versions may allow bingo draws beyond those needed to achieve the bingo game win so as to pay out interim pattern wins at a desired rate. The game-winning awards are generally pari-mutuel in nature. That is, the bingo win award is based upon the total amount wagered on a given occurrence of the bingo game. However, interim pattern awards typically are not pari-mutuel.

Gaming machines such as slot machines and video poker machines have proven to be very popular. However, many games of chance that are played on gaming machines fall into the category of Class III games, which may be subject to stricter approval and regulation. Many gaming establishments have a limited number of gaming machines for playing Class III games and a greater number of gaming machines for playing Class II games, such as bingo.

As such, it would be desirable to provide a gaming system wherein a Class II game may be played on a gaming machine with at least some of the "look and feel" of a Class III game. For example, prior art systems have failed to provide a bingo game on a network of gaming machines that satisfies the regulatory requirements for a Class II game while simulating important aspects of a card game, such as a poker game.

SUMMARY OF THE INVENTION

The present invention provides methods and devices for providing a bingo game having aspects of a card game, such as a poker game, on a network of gaming machines. Some implementations include a bingo card display in which areas of a bingo card correspond with playing cards. Some such implementations provide first phase of a bingo game that is concluded when a player daubs a game-ending pattern of a bingo card and a second phase wherein players may establish interim wins by daubing other patterns that correspond to poker hands. Some implementations provide for automatic daubing. In some implementations, only the highest-ranking interim win results in a payout. Preferred implementations provide games with easily recognizable bingo play and payout probabilities similar to existing bingo games.

Some implementations of the invention provide a method of playing an electronic bingo game. The method includes the following steps: conducting an electronic bingo game involving a plurality of players to allow at least one of the plurality of players to achieve a game-winning outcome, the conducting step involving the step of displaying a simulation of a bingo card; displaying a hand of playing cards, each card of the hand corresponding with a corresponding area of the bingo card; allowing players to optionally select cards of the hand; permitting players to draw new cards; displaying a pattern of the bingo card as a result of a card game; and selecting a player who achieves the highest-ranking pattern.

The step of selecting the winning card player may be part of a process of selecting a plurality of winning card players. The game-winning outcome may be achieved prior to or after the step of selecting at least some of the plurality of winning card players. In some implementations, the game-winning outcome is achieved prior to the step of allowing players to draw new cards and in other implementations the game-winning outcome is achieved after the step of allowing players to draw new cards.

Alternative implementations of the invention provide another method of playing an electronic bingo game. The method includes the following steps: forming a plurality of bingo cards by mapping each of a plurality of numbered areas of each bingo card to corresponding playing cards; providing at least some of the plurality of bingo cards to bingo players; conducting a conventional bingo game until a player daubs a game-winning pattern of numbered areas of the player's bingo card; displaying a first hand of playing cards for each player, each card in the hand corresponding to one of the numbered areas of the player's bingo card; allowing players to optionally select cards of the hand; permitting players to draw new cards; displaying second hand of playing cards, the second hand including the drawn cards, if any; and paying out a prize to a player who achieves the highest-ranking second hand. The first and second hands may correspond to patterns on the bingo card.

Still other methods of providing an electronic bingo game are disclosed herein. Some such methods include these steps: selecting a number of balls for an electronic simulation of a ball drop; selecting a type of bingo card, the type including a number of areas and a game-winning pattern; assigning ball numbers of the ball drop to areas of bingo cards; mapping areas of the bingo card to corresponding playing cards; displaying to players a bingo card, a ball drop display, a playing card display and means for daubing; displaying a first ball drop session to players, the first ball drop session including hits that complete a game-winning pattern on at least one player's bingo card; providing the players a predetermined first time to daub hits on their bingo card; displaying a second ball drop session to players, the second ball drop session including hits that complete all players' bingo cards; providing the players a predetermined second time to daub hits on their bingo card; displaying a first hand of playing cards in the playing card display corresponding to selected hits; allowing players to select cards from their hand to hold; allowing players who did not select all cards in their hand the opportunity to draw one or more additional cards; displaying a second hand of playing cards in the playing card display corresponding to selected cards and the drawn cards; determining a winning hand of cards; and indicating the winning hand of cards.

Alternative gaming method according to the invention include the following steps: establishing a mapping between areas on first through Nth bingo cards and corresponding playing cards; determining a game-winning pattern for the first through Nth bingo cards; displaying at least one of the bingo cards and the game-winning pattern on each of a plurality of gaming machines; displaying a first sequence of randomly-chosen numbers on each of the plurality of gaming machines; displaying an initial hand of playing cards corresponding to initial hits of the first sequence of randomly-chosen numbers, the initial hits also corresponding to first areas of a bingo card on the same display; determining a winning bingo player whose game-winning pattern has been filled by hits; allowing players to select some or all cards of the hand of playing cards; displaying a second sequence of randomly-chosen numbers on each of the plurality of gaming machines; displaying a final hand of playing cards; and selecting a winning card player according to the winning card player's final hand.

The step of selecting a winning card player may be part of a process of selecting a plurality of winning card players. In some implementations, winning card players are selected without reference to another player's hand.

The "areas" may be spots of a bingo card. The mapping may be established between various numbers of playing cards and bingo card areas. For example, the mapping may be established between playing cards of a 52-card deck and 52-area bingo cards, between playing cards of a 52-card deck and 25-area bingo cards, or between playing cards of any C-card deck and A-area bingo cards, wherein C and A are predetermined integers. 52-area bingo cards may be configured as 4×13 or 13×4 bingo cards. The method may allow players to accept or reject a displayed bingo card prior to game play.

The step of displaying the bingo cards may involve displaying a playing card symbol in each area of the bingo cards. In some implementations, not all areas of the bingo card will correspond to a particular playing card. In some implementations, the mapping includes making a correspondence between at least one joker and at least one area of the bingo cards. In some implementations, the bingo cards are initially displayed without numbers. The bingo cards may be displayed with card suits and values corresponding to areas of the bingo cards. Alternatively, the bingo cards may be displayed, at least initially, without reference to a mapping between areas of the bingo cards and playing cards.

The method may include the steps of determining a progressive pattern for the first through Nth bingo cards and displaying the progressive pattern on each of the plurality of gaming machines. More than one bingo card may be displayed on at least some of the plurality of gaming machines. In some such implementations, the method involves displaying a first bingo card having areas corresponding to playing cards and a second bingo card indicating the game-winning pattern.

The mapping may be different for each of the first through Nth bingo cards. The step of displaying at least one of the bingo cards may include the steps of receiving and processing an RNG seed. The may include the step of displaying a draw key configured to identify draw cards after players have selected some or all cards of the hand of playing cards.

The step of displaying an initial hand of playing cards may include displaying M playing cards corresponding to the first M hits, displaying M playing cards corresponding to M randomly-selected hits, or displaying M playing cards corresponding to a predetermined sequence of M hits.

The step of displaying a first sequence of randomly-chosen numbers may involve displaying a first ball drop session. Players may be allowed an opportunity to daub randomly-chosen numbers corresponding to areas of a displayed bingo card. The players may be allowed a predetermined period of time within which to daub. Playing cards corresponding to undaubed hits may or may not be counted in the final hand. Playing cards corresponding to undaubed hits may or may not be selected for the final hand.

The game-winning pattern may be completed by hits of the first sequence of randomly-chosen numbers. The winning bingo player may be determined before or after the winning card player is selected. Moreover, the winning bingo player may be determined before or after the initial hand of playing cards is displayed.

The final hand may include playing cards corresponding to final hits of the second sequence of randomly-chosen numbers. The final hits may also correspond to second areas of the bingo card on the same display. However, the final hand may have the same playing cards as the initial hand.

Some implementations of the invention provide a method of creating a graphical user interface for a gaming machine. The method includes these steps: displaying a first bingo card in a first portion of a gaming machine display, each area of the first bingo card corresponding to a playing card; displaying a ball drop of randomly-chosen numbers in a second portion of the gaming machine display; displaying playing cards in a third portion of the gaming machine display, the playing cards corresponding to areas of the bingo card and to at least some of the randomly-chosen numbers; and displaying a draw key in a fourth portion of the gaming machine display, the draw key indicating playing cards that are available if a player chooses not to hold all playing cards in an initial hand.

The steps of displaying the bingo card, the ball drop, the playing cards and the draw key may be performed simultaneously. The method may include the step of displaying a daub icon configured to allow a player to daub hits from the ball drop display that correspond with areas of the bingo card. The first bingo card may be displayed, at least initially with or without numbered areas and/or playing card icons. The method may include the step of simultaneously displaying a second bingo card having a game-winning pattern. Areas of the second bingo card may or may not correspond to playing cards.

If the display is a touch-screen display, the method may include the step of allowing a player to select playing cards by touching selected playing cards on the display or of allowing a player to daub hits from the ball drop display that correspond with areas of the bingo card. Playing cards may be displayed that correspond with hits from the ball drop display.

Some embodiments of the invention provide a gaming network for playing an electronic bingo game. The gaming network includes a plurality of gaming machines and a game server. The game server is configured to transmit game data to the plurality of gaming machines for conducting an electronic bingo game that allows at least one of a plurality of players to achieve a game-winning outcome. The game data include simulated bingo cards for display on the plurality of gaming machines. Each of the plurality of gaming machines is configured to do the following: display a hand of playing cards, each card of the hand corresponding with a corresponding area of the bingo card; allow players to optionally select cards of the hand; permit players to draw new cards; and display a pattern of the bingo card as a result of a card game. The game server is further configured to select winning card players who achieve winning patterns.

Alternative embodiments of the invention provide computer software embodied in a machine-readable medium. The computer software includes instructions for controlling devices in a gaming network to perform the following steps: conducting an electronic bingo game involving a plurality of players to allow at least one of the plurality of players to achieve a game-winning outcome, the conducting step comprising displaying a simulation of a bingo card; displaying a hand of playing cards, each card of the hand corresponding with a corresponding area of the bingo card; allowing players to optionally select cards of the hand; permitting players to draw new cards; displaying a pattern of the bingo card as a result of a card game; and selecting a winning card player who achieves the highest-ranking pattern.

A first part of the software may be stored in a memory of a game server and a second part of the software may be stored, at least temporarily, in memories of a plurality of gaming machines. The step of selecting the winning card player may be part of a process of selecting a plurality of winning card players.

Alternative implementations of the invention provide computer software embodied in a machine-readable medium. The computer software includes instructions for controlling devices in a gaming network to perform the following steps: selecting a number of balls for an electronic simulation of a ball drop; selecting a type of bingo card, the type including a number of areas and a game-winning pattern; assigning ball numbers of the ball drop to areas of bingo cards; mapping areas of the bingo card to corresponding playing cards; displaying to players a bingo card, a ball drop display, a playing card display and means for daubing; displaying a first ball drop session to players, the first ball drop session including hits that complete a game-winning pattern on at least one player's bingo card; providing the players a predetermined first time to daub hits on their bingo card; displaying a second ball drop session to players, the second ball drop session including hits that complete all players' bingo cards; providing the players a predetermined second time to daub hits on their bingo card; displaying a first hand of playing cards in the playing card display corresponding to selected hits; allowing players to select cards from their hand to hold; allowing players who did not select all cards in their hand the opportunity to draw one or more additional cards; displaying a second hand of playing cards in the playing card display corresponding to selected cards and the drawn cards; determining a winning hand of cards; and indicating the winning hand of cards.

Other embodiments of the invention also provide computer software embodied in a machine-readable medium. The computer software includes instructions for controlling devices in a gaming network to perform the following steps: establishing a mapping between areas on first through Nth bingo cards and corresponding playing cards; determining a game-winning pattern for the first through Nth bingo cards; displaying at least one of the bingo cards and the game-winning pattern on each of a plurality of gaming machines; displaying a first sequence of randomly-chosen numbers on each of the plurality of gaming machines; displaying an initial hand of playing cards corresponding to initial hits of the first sequence of randomly-chosen numbers, the initial hits also corresponding to first areas of a bingo card on the same display; determining a winning bingo player whose game-winning pattern has been filled by hits; allowing players to select some or all cards of the hand of playing cards; displaying a second sequence of randomly-chosen numbers on each of the plurality of gaming machines; displaying a final hand of playing cards; and selecting a winning card player according to the winning card player's final hand.

These and other features and advantages of the invention will be described in more detail below with reference to the associated drawings.

DESCRIPTION OF THE PREFERRED EMBODIMENTS

Reference will now be made in detail to some specific embodiments of the invention including the best modes contemplated by the inventors for carrying out the invention. Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims. Moreover, numerous specific details are set forth below in order to provide a thorough understanding of the present invention. The present invention may be practiced without some or all of these specific details. In other instances, well known process operations have not been described in detail in order not to obscure the present invention.

Figure 1:
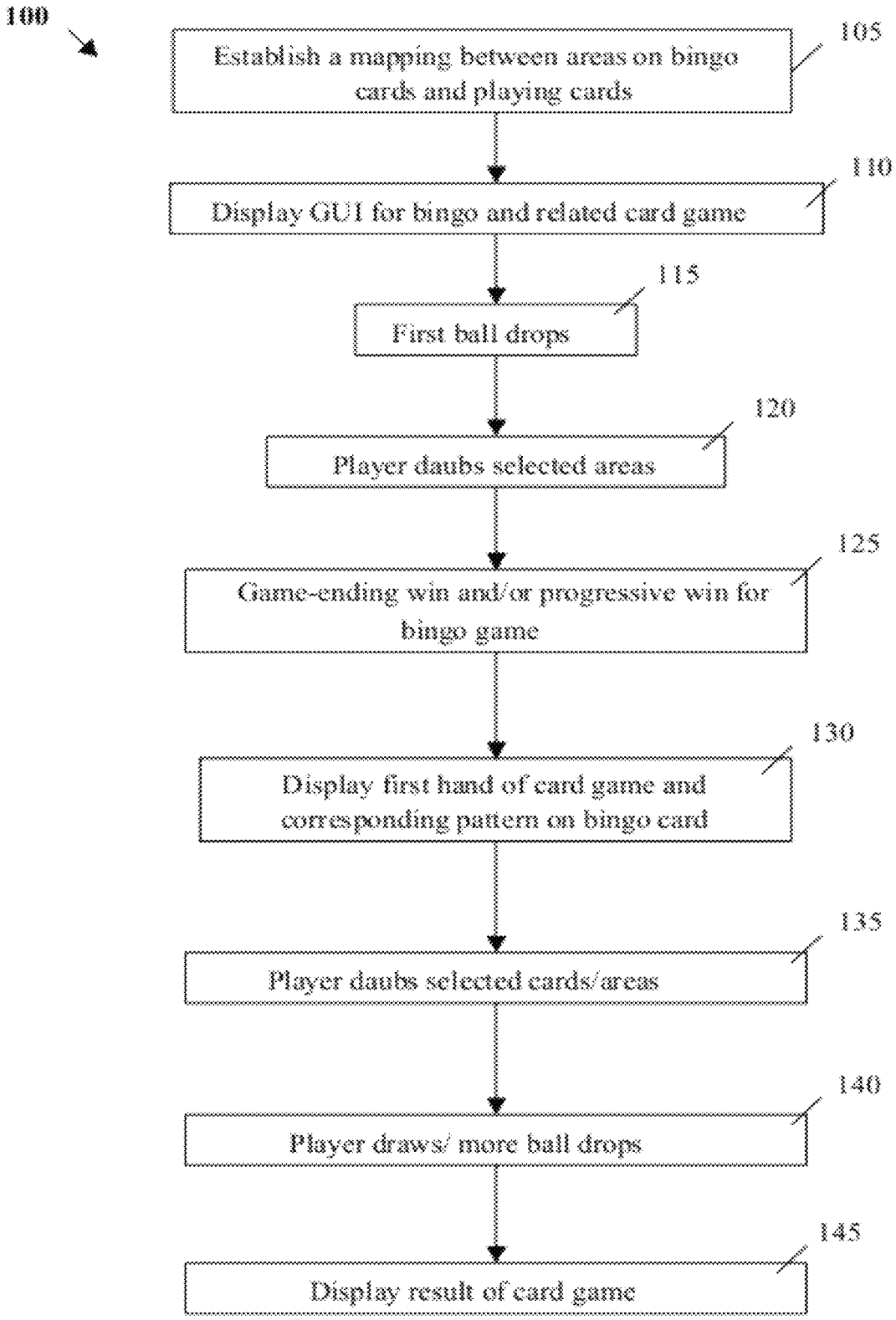
FIG. 1 is a flow chart that outlines some methods of the present invention.

The present invention provides methods and devices for providing, on a network of gaming machines, a bingo game having aspects of a card game, such as a poker game. FIG. 1 is a flowchart that provides an overview of some methods of the present invention. Those of skill in the art will appreciate that the steps of method 100 need not be performed (and in some implementations are not performed) in the order shown. Moreover, some implementations of method 100 may include more or fewer steps than those shown in FIG. 1.

Step 105 involves the establishment of a correspondence or "mapping" between areas (e.g., squares) on bingo cards and playing cards. Step 105 may be performed, for example, by one or more logic devices of a game server or another computing device in communication with a game server. Preferably, each area of a bingo card will correspond to a particular playing card. The playing cards may be, for example, the 52 cards of a standard playing card deck. In some implementations, one or more areas of a bingo card may correspond to a "wild" card of the player's choice.

Figure 2:
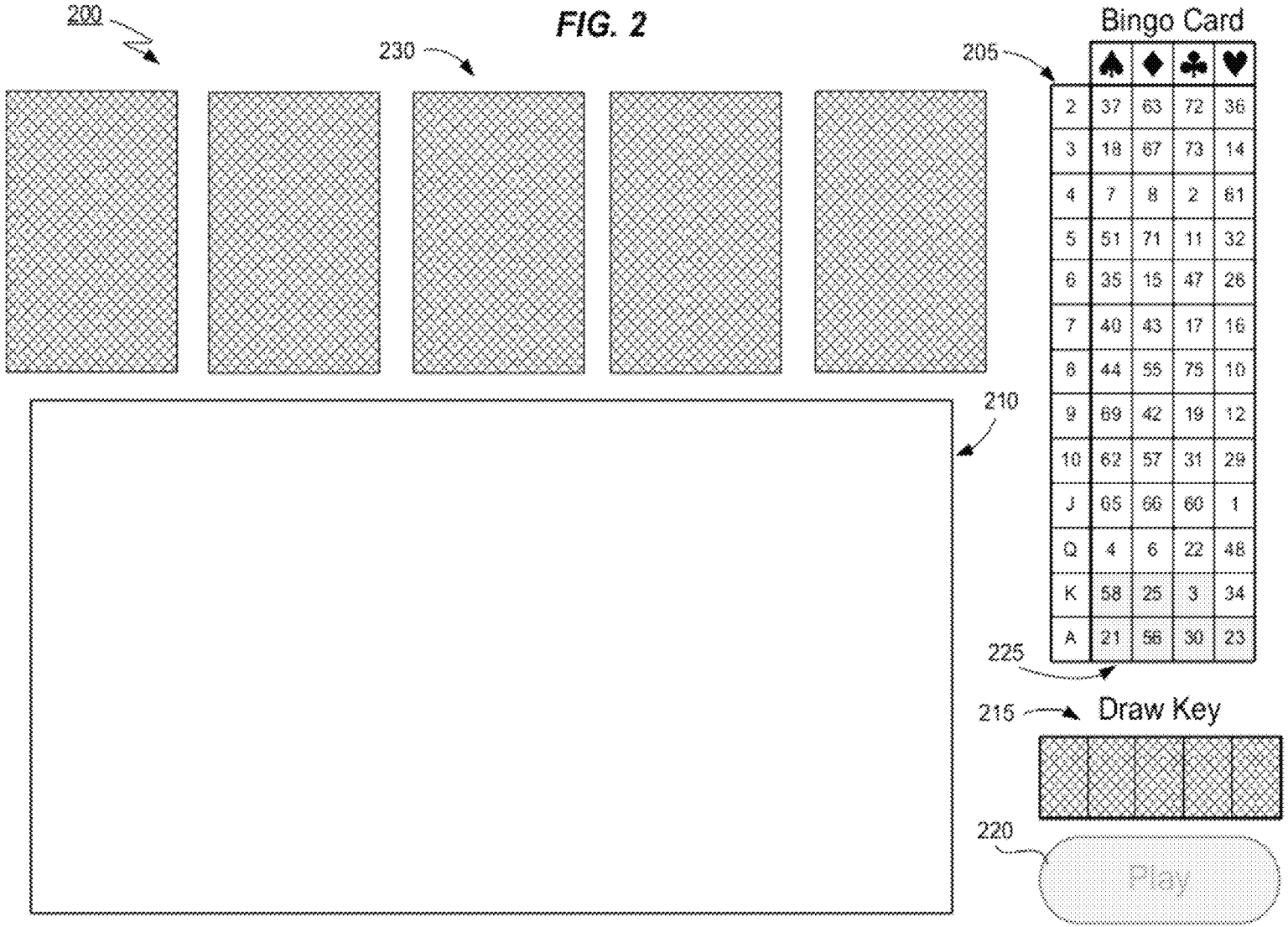
FIG. 2 illustrates a display at a beginning stage of play according to some implementations of the invention.

The type of mapping can vary, according to various implementations of the invention. In some implementations (and as illustrated in FIG. 2 et seq., below), the bingo card is a 4×13 (or 13×4) card formatted such that rows or columns of the card correspond to playing card suits or denominations, e.g., 2 through ace. Such implementations provide a bingo card with a square corresponding to all 52 cards of a standard deck. In other implementations, the bingo card is a standard 5×5 bingo card and not all playing cards of a standard deck are mapped to squares of the bingo card. Other implementations use yet other formats of bingo cards. A mapping for a plurality of such bingo cards will be made in step 105, such that many players can simultaneously play a bingo game. The bingo card may be shown on a display device of a gaming machine, details of which will be discussed below. However, the mapping may or may not be apparent from an inspection of the bingo card.

In step 110, a GUI is displayed to allow bingo play and to display poker hands. In some preferred implementations, the GUI includes at least one bingo card showing a game-winning pattern (and preferably a pattern for winning a progressive jackpot, sometimes referred to herein as a "progressive pattern," a "progressive win pattern," or the like), a display corresponding to a "ball drop" of randomly-chosen numbers displayed during bingo play, a display simulating playing cards and one or more buttons or the like to allow a player to daub, wager, draw cards, etc. Some implementations permit a player to accept or reject an initially-displayed bingo card and to choose another card.

Many types of bingo card displays may be used according to various implementations of the invention. As noted above, the bingo cards may be a standard 5×5 bingo card, a 4×13 (or 13×4) card, or any other convenient bingo card layout. As noted above, some preferred implementations involve a bingo card display formatted such that rows or columns of the card correspond either to playing card suits or denominations. The areas of the card may display playing card symbols and/or numbers corresponding to the numbers displayed during the ball drop. However, as discussed below, some implementations do not display numbers on the bingo cards during an initial stage of play. For example, the numbers on the bingo cards may be concealed until after the players have selected playing cards to hold and chosen to draw new cards (or to hold all cards).

Some implementations display more than one bingo card. In some such implementations, two bingo cards will be displayed for each bingo game. One bingo card includes the game-winning pattern (and preferably a progressive pattern) and the other bingo card indicates a correspondence between areas of the bingo card and playing cards. Some implementations display multiple bingo cards to allow a player to play multiple cards during a bingo game and/or to play multiple bingo games simultaneously. According to some such implementations, the additional bingo cards may be purchased before the game starts for an additional fee.

Preferred implementations include at least one draw key (or a similar object) on the display that identifies cards available for a poker draw. Preferably, such implementations do not identify the draw cards available until after the player chooses to draw. The card identification may be made directly (e.g., by playing card symbols) or indirectly, via information from which the cards' identities may be determined. For example, the draw key may indicate numbers displayed on a bingo card, "hits" from the ball drop, etc. Some such implementations provide multiple draw keys and multiple hand displays, allowing a player to play, e.g., multiple simulated poker hands during a single bingo game.

The ball drop display indicates the numbers to be used in playing the bingo game. Those of skill in the art will realize that the numbers used in an electronic bingo game may be displayed in any convenient fashion and that a simulated "ball drop" is merely one such example. As discussed below, the number of balls displayed and the timing of the ball drops may vary according to the implementation.

Various methods may be used to indicate what bingo card, draw key, etc., will be used by a particular gaming machine. In some implementations, a draw key and the bingo card are generated using one or more RNG (random number generating) seeds, each of which will provide a known outcome. U.S. Pat. No. 6,533,664, entitled "Gaming System with Individualized Centrally Generated Random Number Generator Seeds," describes the use of RNG seeds and is hereby incorporated by reference for all purposes. Each of the RNG seeds has been pre-calculated to produce a predetermined outcome when processed by a pre-programmed "deterministic RNG." The RNG seeds are advantageous for security purposes. Moreover, they are easy to implement because most existing gaming machines use an RNG. Replacing this with a deterministic RNG allows central determination games to be implemented with minimal changes to existing Class III machines.

In some implementations, the draw key(s) and the bingo card(s) may be generated from different RNG seeds and in others they are generated from the same RNG seed. Even if the same RNG seed is used, the gaming machines may receive information specifying how much an RNG should cycle before, e.g., generating a draw key.

Using RNG seeds to indicate what bingo card, draw key, etc., will be used by a particular gaming machine is generally more efficient than using, for example, a table of numbers/desired outcomes/desired displays. However, in other embodiments, such game data may be transmitted from the game server to gaming machines in the form of a number, a combination of symbols, etc., each of which corresponds to a game feature (e.g., a bingo card display). Any convenient method may be used to distribute game features and other game data (e.g., ball drop data) from the game server and no RNG seed is required. In fact, some gaming machines may not have any RNG capability, or this capability may be disabled in order to satisfy gaming regulators. In some implementations, when a request for multiple game features (e.g., multiple hands of poker, multiple bingo cards, etc.) has been received from the same source, multiple game features will be issued to the source if the request is accepted.

In step 115, a first ball drop session takes place. This first ball drop session may include a plurality of single or multiple ball drops and intervening pauses, during which players have the opportunity to daub hits corresponding to numbers on their bingo card(s). The significance of the first ball drop session may vary according to the implementation. In some implementations, one of which is described below with reference to FIG. 2 et seq., the first ball drop session continues until a player daubs a game-winning pattern and wins the bingo game (steps 120 and 125).

In other implementations, the first ball drop session may not be sufficient to establish a game-winning event, but will be sufficient to complete a first hand, e.g. a poker hand, which is displayed (step 130). In such implementations, step 130 takes place before step 125 and possibly before step 120. In some such implementations, the ball drops may be synchronized. For example, after the first ball drop session establishes a poker hand, all players must choose to draw or hold (step 135) before the next ball drop session (step 140). Even though some players may choose to hold all their initial cards, step 135 will sometimes be referred to herein as a "draw," a "draw state," or the like. Some implementations allow a player to select which cards to keep and other implementations allow a player to select which cards to discard. Some implementations require a player to daub cards to hold and/or draw within a predetermined time after a selected event, e.g. during a timed pause between ball drops. In some such implementations, undaubed cards are regarded as "slept" cards, as discussed in more detail below.

In some implementations, the "hits" on the bingo card are not indicated during an initial draw that completes a first hand of cards. For example, the numbers of the ball drop and/or the bingo card(s) may not be revealed until after the draw state (step 135). Only then will a player know whether the ball drop has resulted in a game-winning pattern on a bingo card.

Some alternative implementations provide an additional mapping between numbers indicated in a ball drop and the numbers on the bingo card that will correspond to a hand of a card game, such as a poker hand. The additional mapping may be made, for example, by randomly selecting "hits" from a ball drop session, e.g., from the first ball drop session. In some such implementations, two players having the same ball drop and bingo card could receive different hands. The mapping may be made via an RNG seed or in any convenient fashion. Some such implementations allow a player to daub a game-winning pattern (steps 120 and 125) before the cards of the first hand are revealed (step 130).

After the first hand has been revealed and the player has drawn cards (or chosen to hold all cards), additional balls are dropped (step 140). In some implementations, all of the remaining balls are dropped in step 140. The total number of balls dropped varies according to the implementation. For example, some implementations drop a total of 75 balls, as in traditional bingo. Other implementations drop a total of 52 balls, each of which corresponds to an area of a bingo card and a playing card in a standard deck.

Finally, the result of the card game is displayed (step 145). In preferred implementations, the result involves a hand of cards that corresponds with a pattern on a bingo card. In addition, the winning player's gaming machine may display a message, flash lights, make sounds, etc., indicating a win. Wins may be determined in a wide variety of methods according to the present invention. In some implementations, only the highest-ranking hand among all players will result in a payout. In other implementations, the top N hands among all players will receive a payout, where N is a predetermined integer. In yet other implementations, the win (or lack of a win) is based on the particular hand/pattern and is not affected by another player's hand.

Some specific implementations will now be discussed with reference to FIG. 2 et seq. In the first such implementation, the "game-ending" win and progressive win (if any) of the bingo game are resolved prior to displaying a first playing card hand. Then, the game continues for interim, poker-style wins. According to some such implementations, the player is thereby allowed time to make poker "hold" decisions without delaying play on any other machines.

FIG. 2 depicts display 200, which is a graphical user interface ("GUI") for playing "draw bingo" games according to some implementations of the invention. Display 200 is shown at a moment in time prior to game play. Display 200 includes bingo card display 205, ball drop display 210, draw key display 215, button 220 and card display 230. Additional controls, whether part of a gaming machine or of an associated or alternative GUI, may provide additional functions such as allowing a player to make or change a wager, accept or reject a bingo card, etc. Accordingly, at the time corresponding to the condition of display 200 shown in FIG. 2, a player may place and/or alter a wager, change the bingo card, etc.

Here, bingo card 205 is a 4×13 card with numbers randomly distributed on the squares. The rows and columns of bingo card 205 are labeled with poker card suit and face values, so that each entry's row and column shows what poker card (suit and face value) it is associated with. For example, the number 62 is associated with a 10 of spades. In some embodiments, a card image is used as the background of each area. As noted above, in alternative implementations the numbers are not shown on bingo card 205 until a later stage of the game.

Preferably, both the game-winning pattern and the progressive pattern, if any, are indicated prior to bingo play. The game-winning pattern and the progressive pattern may be the same pattern or a different pattern. Here, game-winning pattern 225 is shown as a shaded region of bingo card 205. In some implementations, the progressive pattern must be hit within a certain number of ball drops. In this example, the progressive pattern is the same 7-area pattern as the game-winning pattern. The progressive pattern must be hit in the first 11 balls for a win. However, the game-winning and progressive patterns may be any shape and location. For example, in alternative implementations the progressive pattern is a 5-spot pattern that must be hit in 5 balls. If the pattern is displayed on bingo card 205, the progressive pattern may correspond, for example, to a royal flush of one specific suit (e.g., spades). Moreover, the areas that form the pattern need not be contiguous.

Ball drop display 210 does not include any balls at this stage, because none have yet been dropped. The embodiment illustrated in FIG. 2 is implemented for ball drop numbers 1-75, which is consistent with the format of existing bingo games. Alternative implementations use other ranges of numbers, e.g., 1-52. Preferably, the range of numbers used is greater than or equal to the number of playing cards in the deck corresponding to the relevant card game. If the relevant card game is poker, for example, there should be at least 52 numbers in the ball drop, though these need not begin with the number 1 or be incremented by 1 unit.

Draw key 215 will be used in a later stage of play, if and when a player decides to hold only some cards from a first hand and to draw new cards. Draw key 215 specifies which bingo hits will be used to draw from when replacing discards. In this implementation, draw key 215 consists of 5 ordinal numbers (1st, 2nd, 3rd, etc.), in the range of 6th through 52nd. Each ordinal number corresponds to a "hit," wherein a number of the ball drop corresponds with a number of bingo card 205. For example, if the first number in the draw key is 12, the 12th hit is the first card drawn. The game (e.g., a processor on the gaming machine or a game server) finds the 12th hit, finds the poker card associated with that bingo ball number and shows that card as the first card drawn. Preferably, draw key 215 is different for every player and for every game.

The identities of the cards available for a draw are preferably determined, but not shown, at this stage of the game. A graphical presentation may show that the draw key has been generated and is currently hidden. In one implementation, the numbers within the draw key begin to spin, like reels. Then a window closes, hiding the results of the spin from the player, while a reel-stop sound plays to indicate that the results have been determined.

In this embodiment, button 220 can provide various functions at different stages of a game. At this stage, button 220 is configured to allow a player to start the game. Additional functions of button 220 will be described below.

Card display 230 is used to display a hand of playing cards at later stages of a game. Here, card display 230 is configured to display up to 5 cards. However, alternative implementations provide card displays with more of fewer cards, according to the card game to be displayed in connection with bingo play. For example, a 7-card display is used for implementations of a "7-card stud" poker game.

Figure 2A:
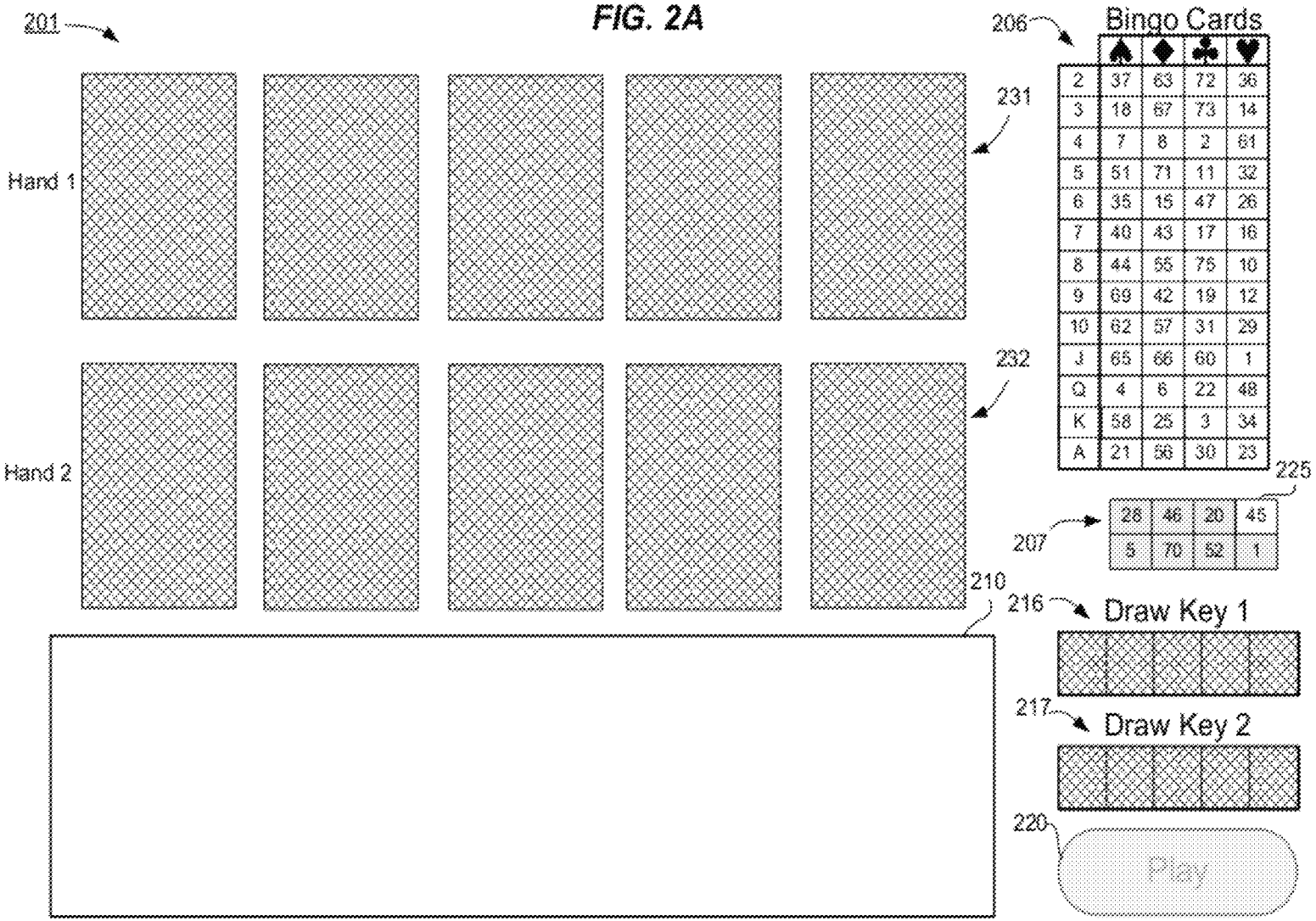
FIG. 2A illustrates a display at a beginning stage of play according to alternative implementations of the invention.

In alternative implementations, game-winning pattern 225 and/or a progressive pattern may be indicated on another part of the display, e.g., on another bingo card that does not have numbered areas corresponding to playing cards. One such implementation is illustrated in FIG. 2A. Here, game-winning pattern 225 of display 201 is depicted on bingo card 207, the areas of which do not correspond to playing cards. The areas of bingo card 206 correspond to playing cards. Display 201 also includes draw keys 216 and 217, which allow draws for the cards of card displays 231 and 232, respectively. Accordingly, a player may play multiple hands of cards during the same bingo game. In some implementations, the first hand of cards will be included with the price of playing a game of Draw Bingo and additional hands may be played for an additional fee.

Some implementations for playing multiple hands involve using more or fewer draw keys than card hands. For example, some implementations allow 2 or more hands to be played from the same draw key. Alternative implementations allow more draw keys than card hands, preferably for an additional fee. In such implementations, a player may be able to select cards from more than one draw key for the same hand.

Figure 3:
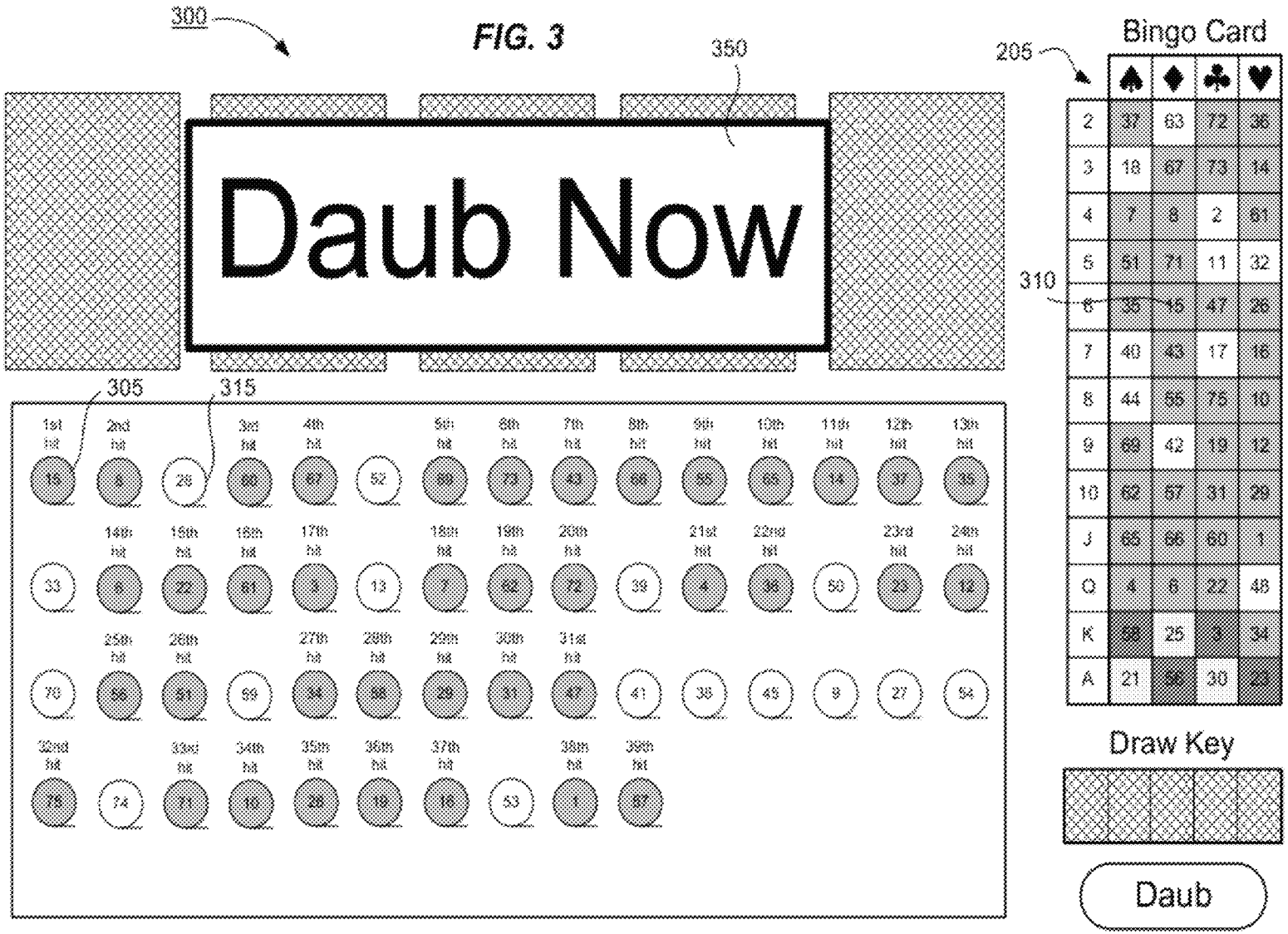
FIG. 3 illustrates a display at a subsequent stage of play according to some implementations of the invention.

FIG. 3 depicts display 200 at a later stage 300 of game play. Here, ball drop display 210 indicates a series of balls drawn in an initial ball drop session, in the order they were drawn. Each entry shows whether the ball is a "hit," i.e., whether its number corresponds with a number on bingo card 205. In this example, if an entry is a hit, the entry indicates which hit number it is ($1^{st}$ hit, $2^{nd}$ hit, etc.) and the entry is shaded. For example, ball 305 is the first ball and the first hit. Accordingly, ball 305 is shaded and is labeled "$1^{st}$ hit." The number of ball 305, 15, corresponds with area 310 of bingo card 205. In this example, area 310 also bears the number 15 and is also shaded. Here, area 310 corresponds with the 6 of diamonds. In alternative implementations, an entry that is a "hit" will also show the poker card value that is associated with the number.

The first ball drop session may include, e.g., 2 or more ball releases. In this example, the first ball drop session included 2 ball releases, separated by a timed pause to allow players an opportunity to daub their hits. At stage 300 of the first ball drop session, ball drop display 210 indicates that 55 balls have been dropped, 39 of which are "hits." This player has daubed all hits.

Some implementations of the invention provide for automatic daubing, e.g., by a "daub genie" as implemented in some current gaming machines. However, preferred implementations of the invention require players to daub in order to complete game play. The ball releases continue until the game-ending pattern on at least one player's bingo card has been completed and a game-ending win could be claimed. Accordingly, inset message 350 indicates that a player's game-ending pattern has been completed and that the player must daub in order to claim the game-ending win. In this example, the game server pauses for 3 seconds to allow players to daub, then releases more balls until another player's game-ending pattern has been completed. However, any convenient time interval could be used.

Here, a player can daub all hits in a current ball release by pressing button 220. In some implementations, a touch screen display allows a player to daub by touching part of the display, e.g., by touching part of bingo card 205, ball drop display 210, draw key 215 or card display 230. Some such implementations require a player to daub individual "hits," e.g., individual areas of bingo card 205 or ball drop display 210. In such implementations, the first player to daub the game-winning pattern wins this part of the game. The player's win may be indicated in any way known by those of skill in the art, including an audio indication from a speaker (e.g., of the gaming machine), a "pop-up" or inset on a display screen, flashing lights, etc.

Figure 4:
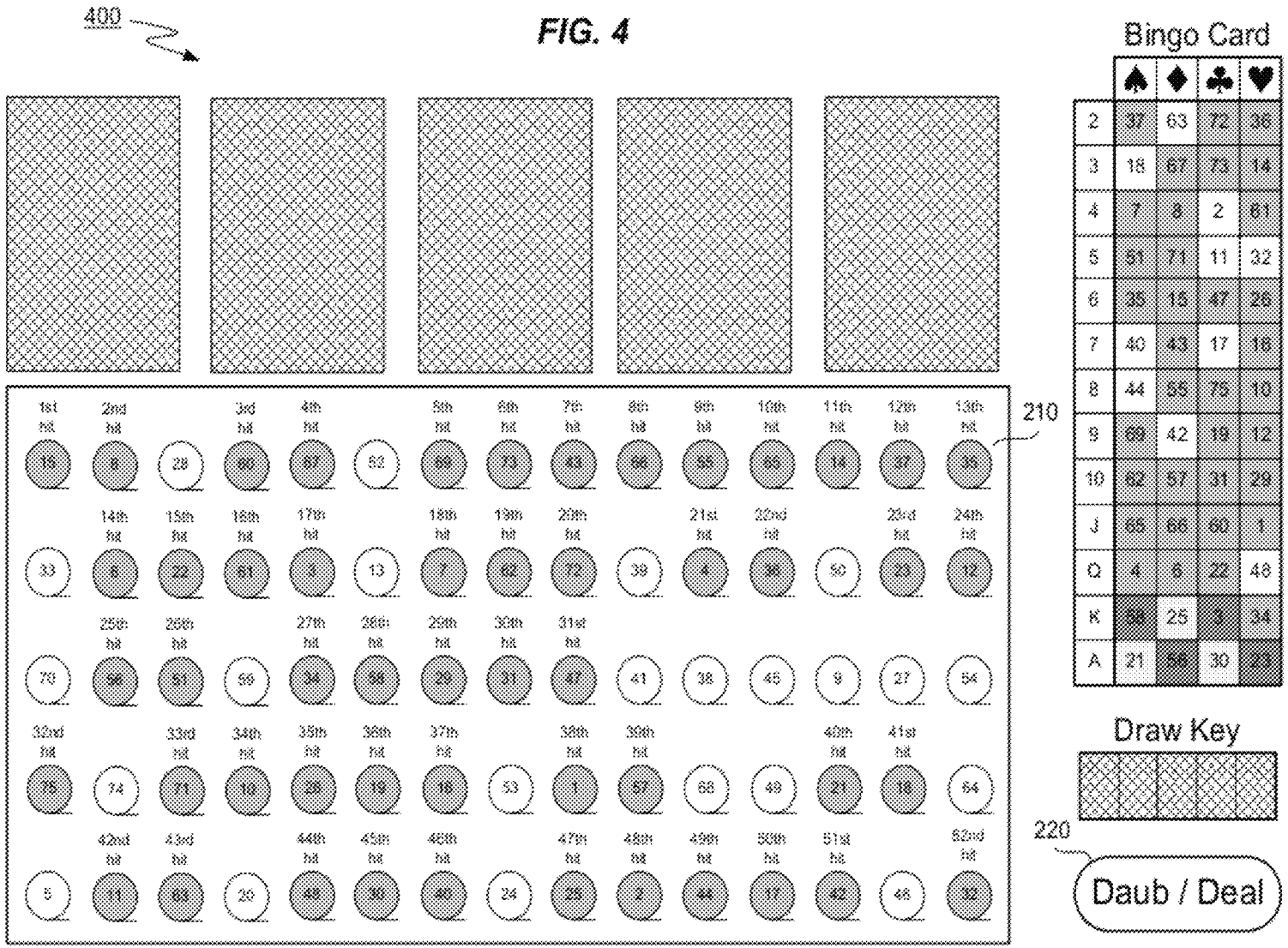
FIG. 4 illustrates a display at a subsequent stage of play according to some implementations of the invention.

As shown in FIG. 4, after the progressive and game-ending wins have been resolved, a server releases all remaining balls in this implementation. Accordingly, ball drop display 210 indicates that all 75 balls have been dropped. In this example, the player must daub again for "hits" to be applied to the player's poker hand. In this implementation, if the player fails to daub, the corresponding undaubed numbers are considered slept and cannot be applied to any wins.

In this example, there are 75 balls and only 52 areas on bingo card 205. Therefore, it is possible for one player to need up to 28 balls released (23 misses and 5 hits) to determine the first 5 cards dealt. It is also possible for another player to hit the game-ending pattern before 28 balls have been released. Thus, it is possible for some or all of one player's first 5 cards dealt to be in the final ball release. To accommodate this possibility, in this embodiment all players must daub the final ball release before the first 5 cards dealt are shown. For convenience, this may be done using button 220, which now is configured as a "Daub/Deal" interface. Because a slow poker player cannot hold up any other player's game, in this implementation there is no need for a daub timeout for the final ball release.

Figure 5:
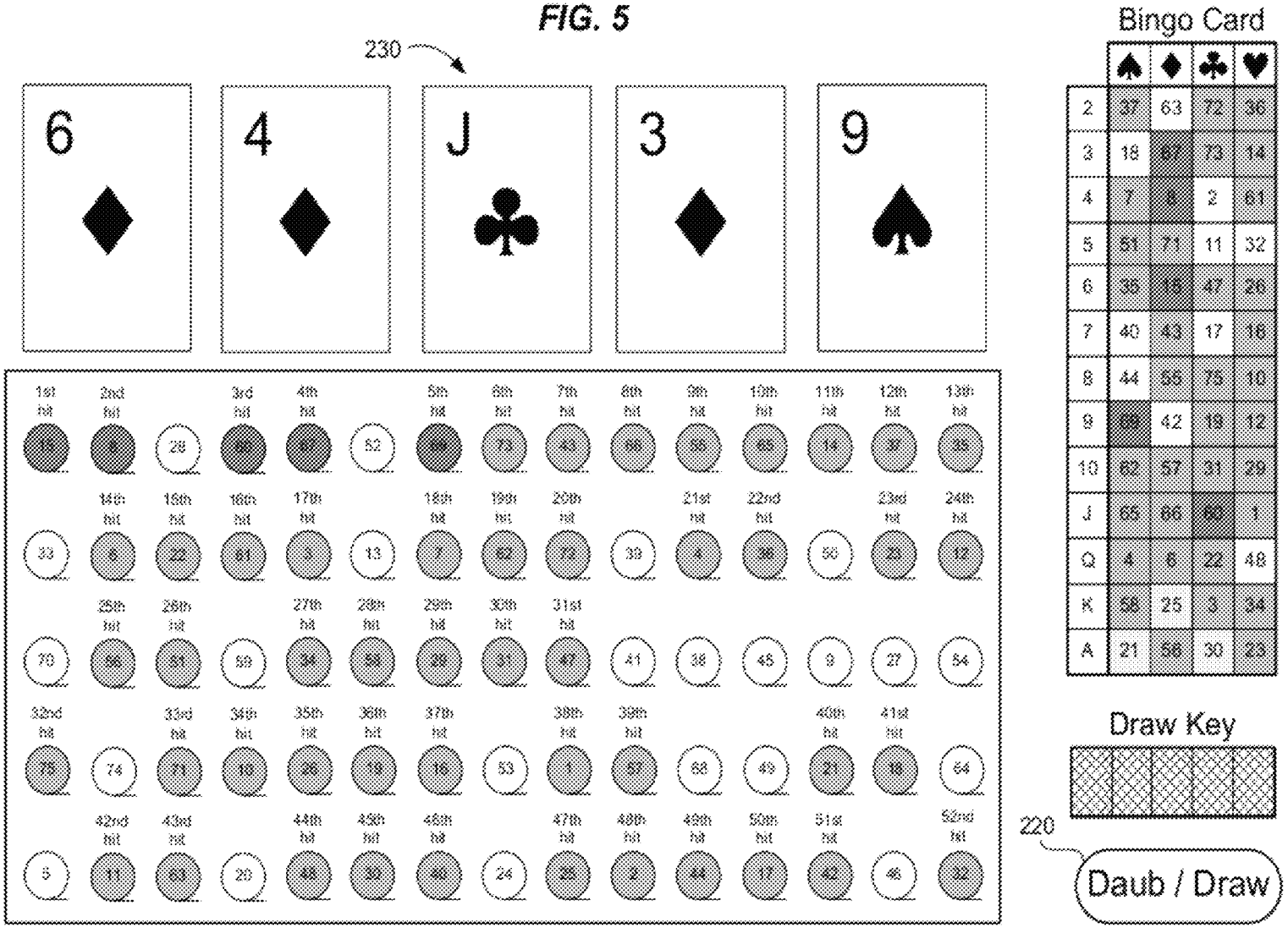
FIG. 5 illustrates a display at a subsequent stage of play according to some implementations of the invention.

In FIG. 5, the player has activated button 220 and therefore a hand of playing cards is revealed in card display 230. In this example, the first 5 hits are shown as the player's dealt poker cards. If the bingo ball range had been 1-52, every ball would have been a hit. If the same "first 5 hits" method had also been employed, the first 5 balls drawn would have determined the player's dealt poker cards. As noted elsewhere in this application, the present invention encompasses many methods of determining the first hand of cards. For example, with a 5-card hand, the $2^{nd}$ through $6^{th}$ or the $3^{rd}$ through $7^{th}$ hits can determine the first hand. Alternatively, every $2^{nd}$ hit, every $3^{rd}$ hit, or any convenient pattern can determine the first hand. The first hand can be selected randomly from the hits, such that 2 players with the same bingo card will have different resulting hands.

Figure 6:
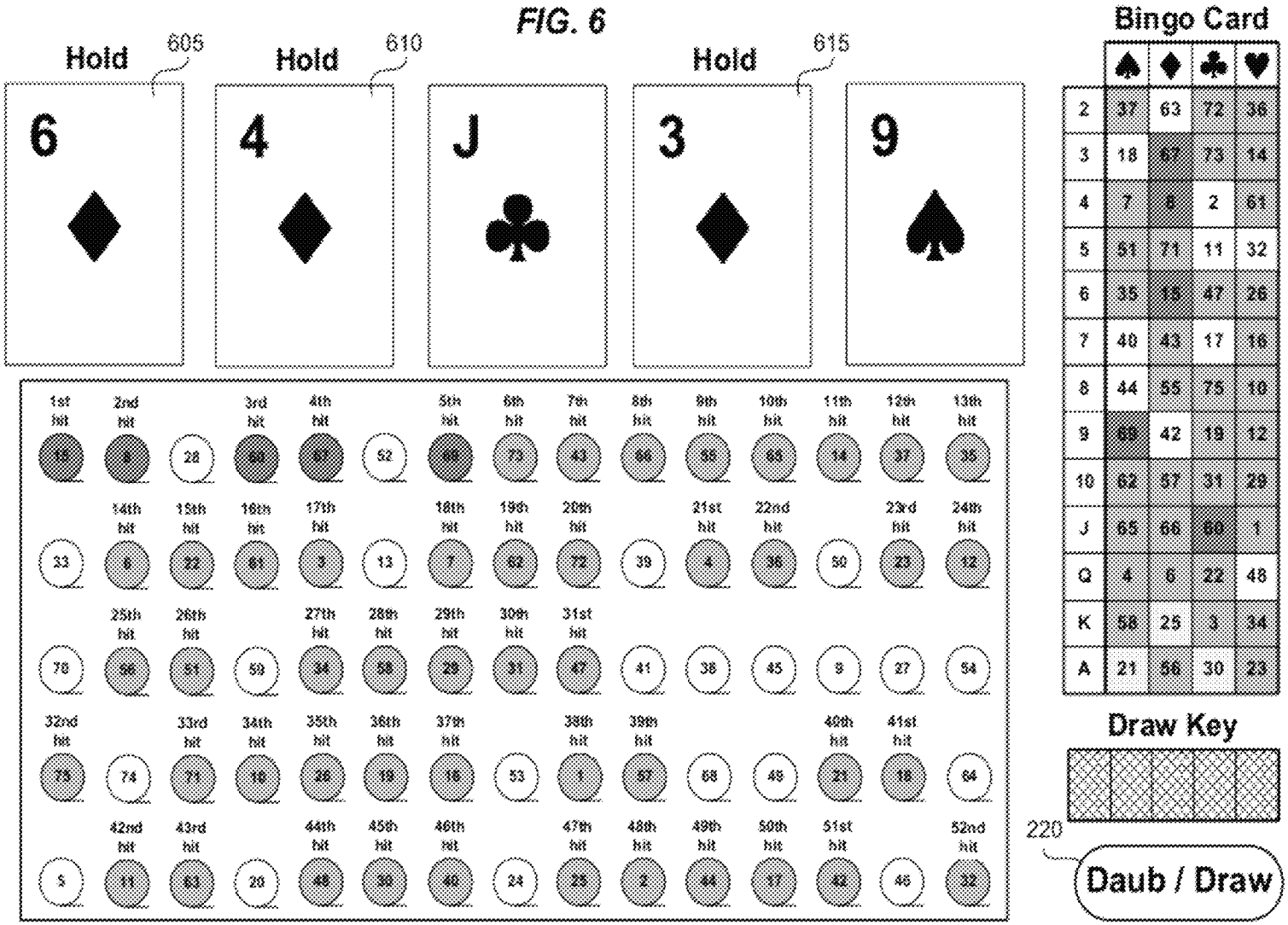
FIG. 6 illustrates a display at a subsequent stage of play according to some implementations of the invention.

As shown in FIG. 6, the player then selects the cards to hold/discard. In this example, the player touches an area of the display screen corresponding with card display 230 to daub selected cards 605, 610 and 615. In alternative implementations, the player may daub the selected cards in other ways, e.g., by pressing the corresponding areas of bingo card 205 or of ball drop display 210. The card selections correspond to patterns on bingo card 205. After the player has daubed cards, the player presses button 220 to confirm the card selection.

Figure 7:
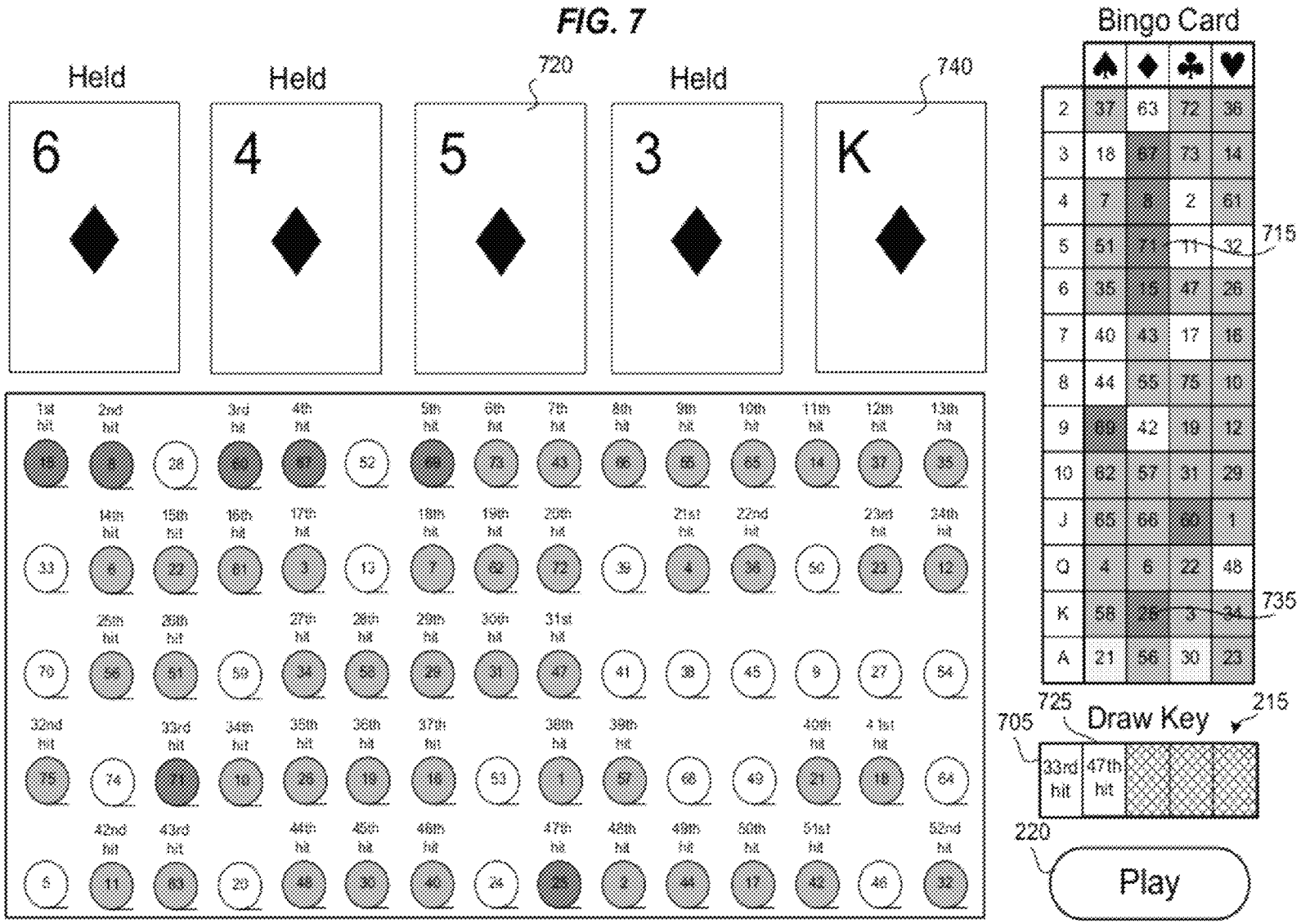
FIG. 7 illustrates a display at a subsequent stage of play according to some implementations of the invention.

The corresponding portions of draw key 215 are then revealed, as illustrated in FIG. 7. Some implementations expose only as much of draw key 215 as is needed and other implementations expose the entire draw key. It is more consistent with traditional poker to only show as much of the draw key as is needed to complete the player's hand.

Here, area 705 of draw key 215 indicates the first drawn card. Area 705 indicates that the $33^{rd}$ hit will be the corresponding number. Ball 710 of ball drop display 210 indicates that the corresponding number will be 71. Number 71 is located on area 715 of bingo card 205. Therefore, the corresponding playing card is the 5 of diamonds, which is displayed in area 720 of card display 230.

The second drawn card is indicated by area 725 of draw key 215, which indicates the $47^{th}$ hit. Ball 730 of ball drop display 210 indicates that the corresponding number will be 25, which is located on area 735 of bingo card 205. The corresponding playing card is the king of diamonds, which is displayed in area 740 of card display 230.

Figure 8:
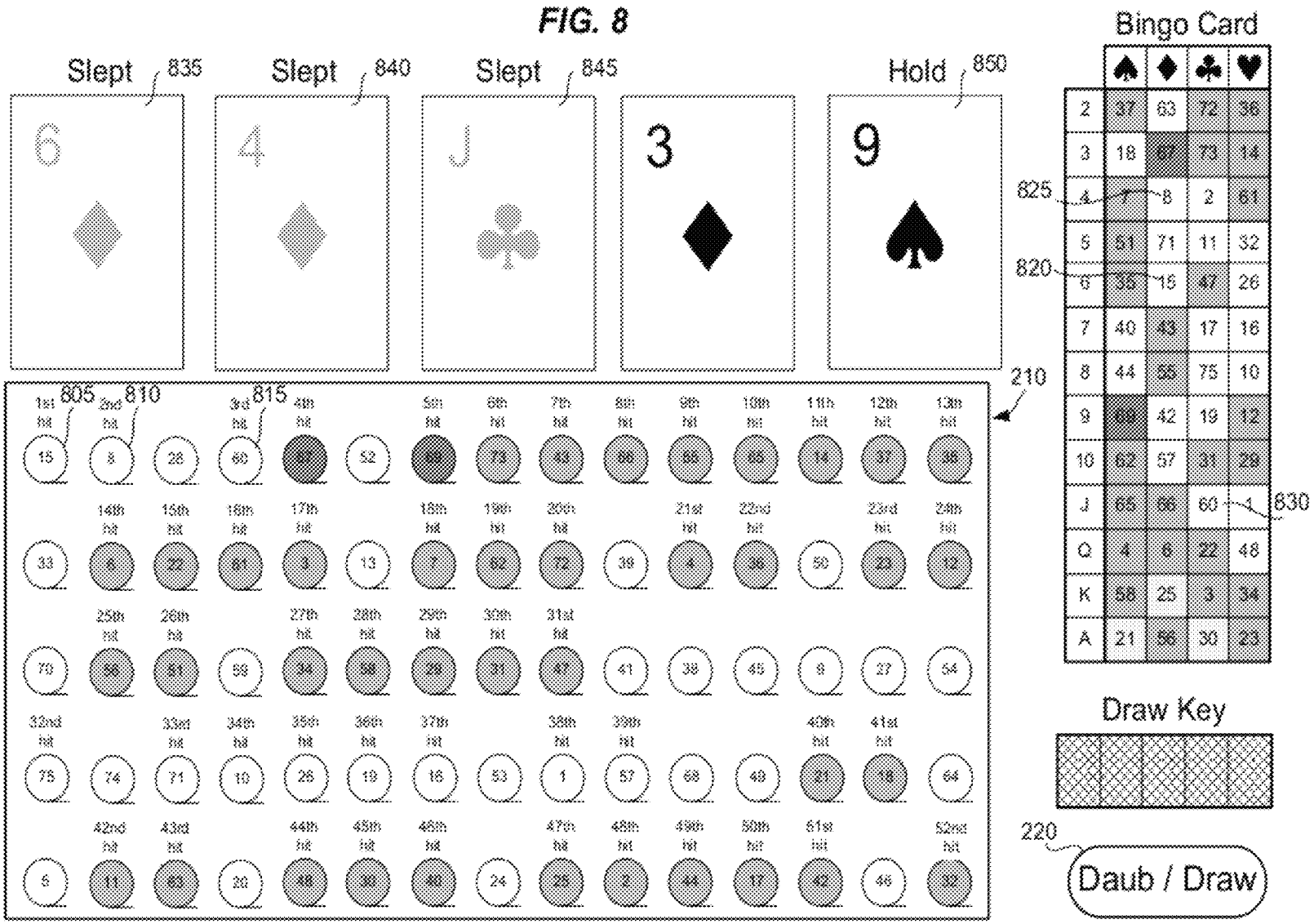
FIG. 8 illustrates a display of "slept" hits according to some implementations of the invention.

In some implementations, if the player had failed to daub any of the numbers from an initial ball drop that were used to form a first hand, they would have been shown as "slept" cards. One example of slept cards is shown in FIG. 8. In this example, the first 5 hits are once again used to determine the first hand of poker. However, $1^{st}$ hit 805, $2^{nd}$ hit 810 and $3^{rd}$ hit 815 of ball drop display 210 map to areas 820, 825 and 830, respectively, of bingo card 205. Hits 805, 810 and 815 are therefore mapped to the 6 of diamonds, the 4 of diamonds and the jack of clubs, respectively. These cards are illustrated in areas 835, 840 and 845 of card display 230. However, these hits were not daubed. Because these hits were not daubed, they are not shaded in ball drop display 210 or bingo card 205. Moreover, the cards illustrated in areas 835, 840 and 845 of card display 230 are displayed as faded or "grayed out," with the label "slept" above the card. The player daubs area 850, indicating that the 9 of spades should be held.

Figure 9:
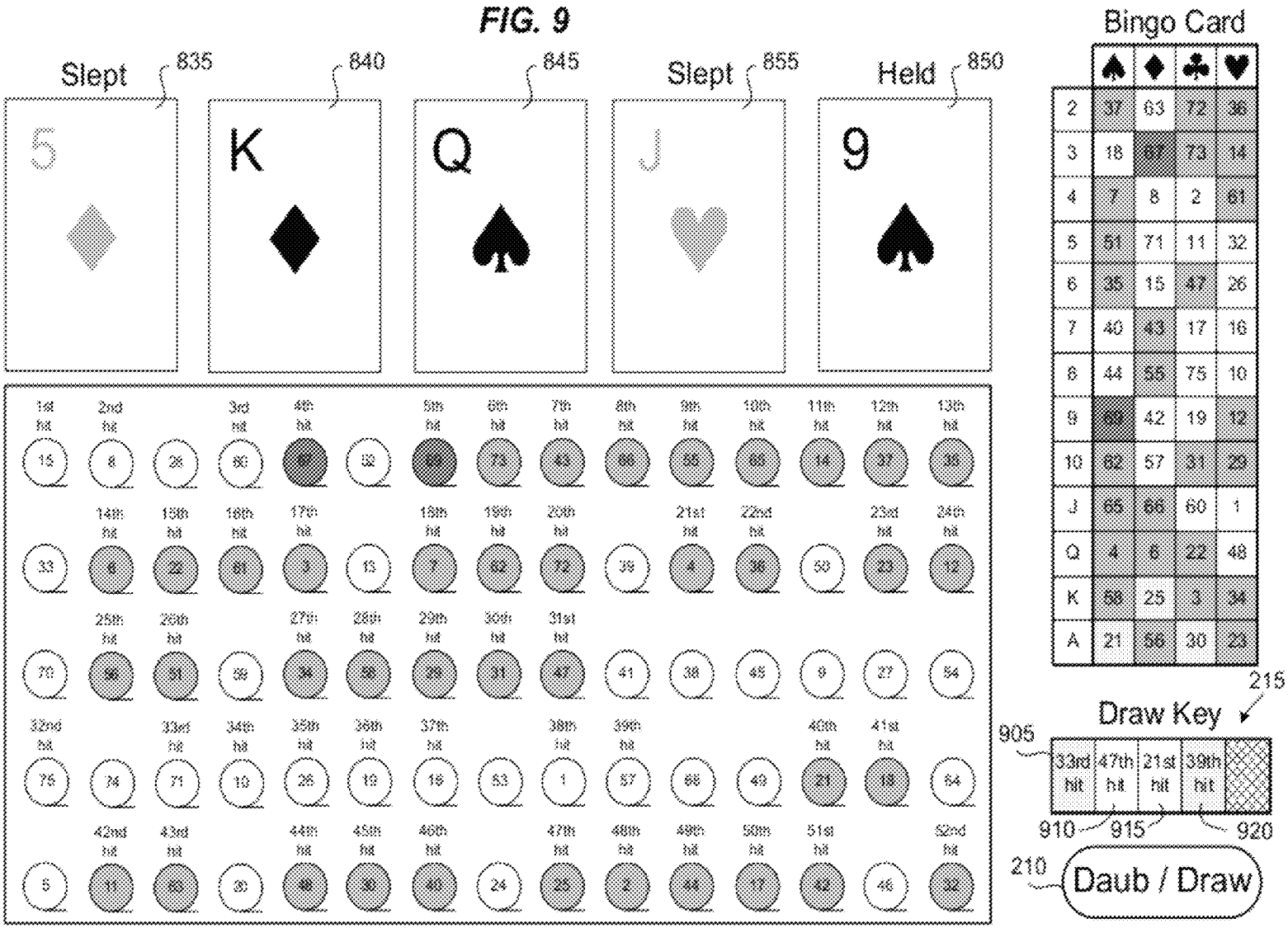
FIG. 9 illustrates a display of "slept" hits at a subsequent stage of play according to some implementations of the invention.

In this implementation, if the hit representing a drawn card was slept, the poker card is still drawn, but the card is labeled as slept and cannot apply towards a win. One example of this process is illustrated in FIG. 9, which is a continuation of the process illustrated in FIG. 8. Here, 4 cards were either discarded or slept. Therefore, areas 905, 910, 915 and 920 of draw key 215 indicate the hits corresponding to the 4 cards drawn. The $33^{rd}$ hit is number 71, which corresponds to the 5 of diamonds according to bingo card 205. However, this number was not daubed, so area 835 of card display 230 indicates that the 5 of diamonds is slept. Areas 910 and 915 indicate that the next cards drawn (the king of diamonds and the queen of spades) correspond to the $47^{th}$ and $21^{st}$ hits, respectively. The numbers corresponding to these hits were daubed, so these cards are displayed normally in areas 840 and 845. However, area 920 indicates that the fourth card drawn, corresponding to the $39^{th}$ hit and number 57, was not daubed. Therefore, the corresponding card (the jack of hearts) is displayed in area 855 as slept.

All cards from the final hand that were not slept are evaluated as a poker hand. The player who daubs the highest-ranked hand/pattern wins this part of the game. If the player has "slept" any hits, it is possible that the final hand may have fewer than 5 cards. Although in this implementation, the "game-winning" phase has already been completed, this win is analogous to an interim win, because this phase is analogous to evaluating a bingo win for the best of several patterns made by areas of bingo card 205 that the player daubed and chose to keep. As described above, a player's "interim win" may be indicated by flashing lights, a coin drop, characteristic sounds, or in any other way known by those of skill in the art.

Figure 10:
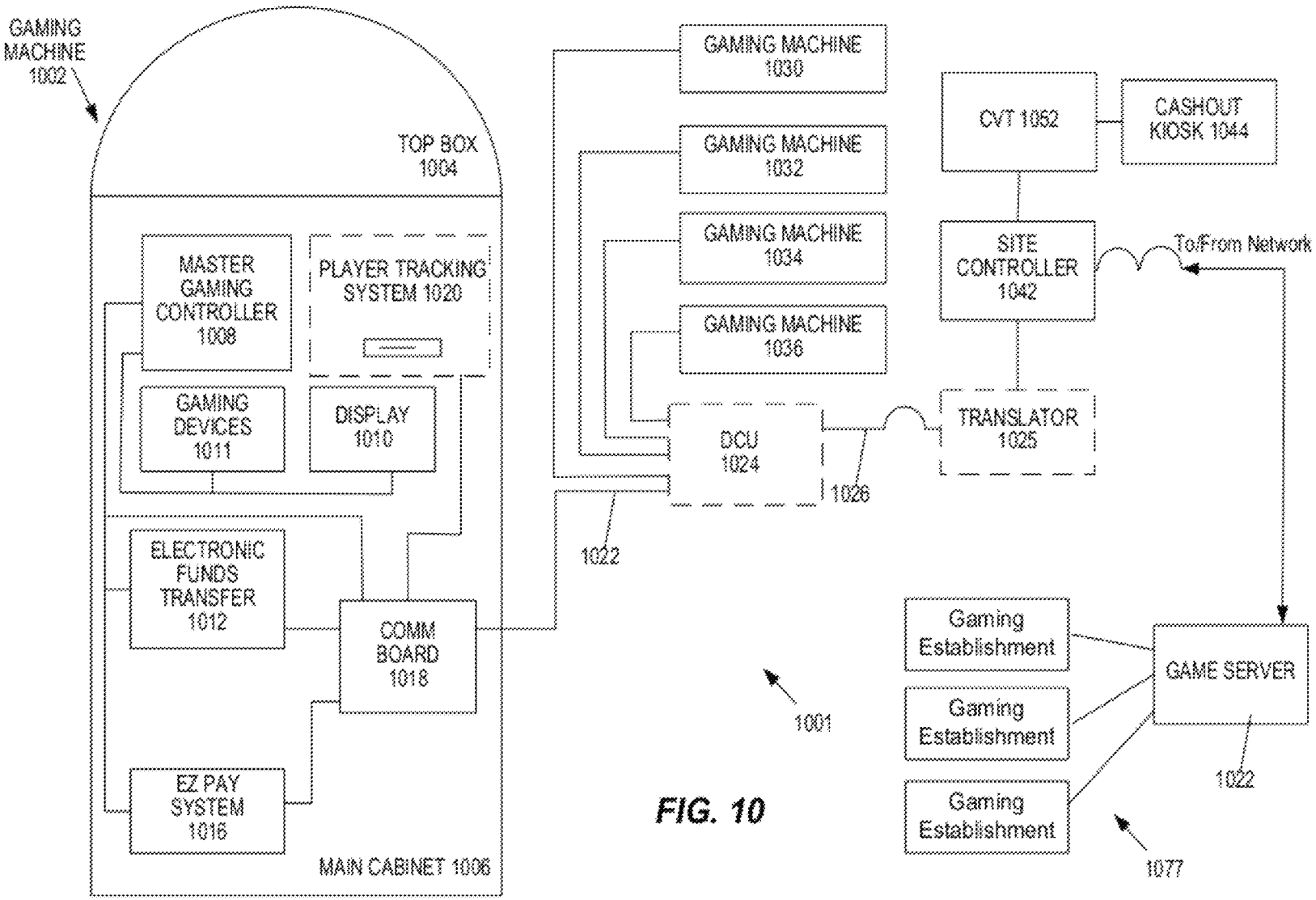
FIG. 10 is a block diagram of a number of gaming machines in a gaming network that may be configured to implement some methods of the present invention.

One example of a gaming machine network that may be used to implement methods of the invention is depicted in FIG. 10. Gaming establishment 1001 could be any sort of gaming establishment, such as a casino, a card room, an airport, a store, etc. However, the methods and devices of the present invention are intended for gaming networks (which may be in multiple gaming establishments) in which there are a sufficient number of Class II gaming machines for bingo play. In this example, gaming network 1077 includes more than one gaming establishment, all of which are networked to game server 1022.

Here, gaming machine 1002, and the other gaming machines 1030, 1032, 1034, and 1036, include a main cabinet 1006 and a top box 1004. The main cabinet 1006 houses the main gaming elements and can also house peripheral systems, such as those that utilize dedicated gaming networks. The top box 1004 may also be used to house these peripheral systems.

The master gaming controller 1008 controls the game play on the gaming machine 1002 according to instructions and/or game data from game server 1022 and receives or sends data to various input/output devices 1011 on the gaming machine 1002. Details of exemplary systems for using a game server to control a network of gaming machines to implement bingo games are described in United States Patent Application No. 60/503,161, filed Sep. 15, 2003 and entitled "Gaming Network with Multi-Player Bingo Game." This application is hereby incorporated by reference for all purposes. The master gaming controller 1008 may also communicate with a display 1010.

A particular gaming entity may desire to provide network gaming services that provide some operational advantage. Thus, dedicated networks may connect gaming machines to host servers that track the performance of gaming machines under the control of the entity, such as for accounting management, electronic fund transfers (EFTs), cashless ticketing, such as EZPay™, marketing management, and data tracking, such as player tracking Therefore, master gaming controller 1008 may also communicate with EFT system 1012, EZPay™ system 1016 (a proprietary cashless ticketing system of the present assignee), and player tracking system 1020. The systems of the gaming machine 1002 communicate the data onto the network 1022 via a communication board 1018.

It will be appreciated by those of skill in the art that the present invention could be implemented on a network with more or fewer elements than are depicted in FIG. 10. For example, player tracking system 1020 is not a necessary feature of the present invention. However, player tracking programs may help to sustain a game player's interest in additional game play during a visit to a gaming establishment and may entice a player to visit a gaming establishment to partake in various gaming activities. Player tracking programs provide rewards to players that typically correspond to the player's level of patronage (e.g., to the player's playing frequency and/or total amount of game plays at a given casino). Player tracking rewards may be free meals, free lodging and/or free entertainment.

Moreover, DCU 1024 and translator 1025 are not required for all gaming establishments 1001. However, due to the sensitive nature of much of the information on a gaming network (e.g., electronic fund transfers and player tracking data) the manufacturer of a host system usually employs a particular networking language having proprietary protocols. For instance, 10-20 different companies produce player tracking host systems where each host system may use different protocols. These proprietary protocols are usually considered highly confidential and not released publicly.

Further, in the gaming industry, gaming machines are made by many different manufacturers. The communication protocols on the gaming machine are typically hard-wired into the gaming machine and each gaming machine manufacturer may utilize a different proprietary communication protocol. A gaming machine manufacturer may also produce host systems, in which case their gaming machine are compatible with their own host systems. However, in a heterogeneous gaming environment, gaming machines from different manufacturers, each with its own communication protocol, may be connected to host systems from other manufacturers, each with another communication protocol. Therefore, communication compatibility issues regarding the protocols used by the gaming machines in the system and protocols used by the host systems must be considered.

A network device that links a gaming establishment with another gaming establishment and/or a central system will sometimes be referred to herein as a "site controller." Here, site controller 1042 provides this function for gaming establishment 1001. Site controller 1042 is connected to a central system and/or other gaming establishments via one or more networks, which may be public or private networks. Among other things, site controller 1042 communicates with game server 1022 to obtain game data, such as ball drop data, bingo card data, etc.

In the present illustration, gaming machines 1002, 1030, 1032, 1034 and 1036 are connected to a dedicated gaming network 1022. In general, the DCU 1024 functions as an intermediary between the different gaming machines on the network 1022 and the site controller 1042. In general, the DCU 1024 receives data transmitted from the gaming machines and sends the data to the site controller 1042 over a transmission path 1026. In some instances, when the hardware interface used by the gaming machine is not compatible with site controller 1042, a translator 1025 may be used to convert serial data from the DCU 1024 to a format accepted by site controller 1042. The translator may provide this conversion service to a plurality of DCUs.

Further, in some dedicated gaming networks, the DCU 1024 can receive data transmitted from site controller 1042 for communication to the gaming machines on the gaming network. The received data may be, for example, communicated synchronously to the gaming machines on the gaming network.

Here, CVT 1052 provides cashless and cashout gaming services to the gaming machines in gaming establishment 1001. Broadly speaking, CVT 1052 authorizes and validates cashless gaming machine instruments (also referred to herein as "tickets" or "vouchers"), including but not limited to tickets for causing a gaming machine to display a game result and cashout tickets. Moreover, CVT 1052 authorizes the exchange of a cashout ticket for cash. These processes will be described in detail below. In one example, when a player attempts to redeem a cashout ticket for cash at cashout kiosk 1044, cashout kiosk 1044 reads validation data from the cashout ticket and transmits the validation data to CVT 1052 for validation. The tickets may be printed by gaming machines, by cashout kiosk 1044, by a stand-alone printer, by CVT 1052, etc. Some gaming establishments will not have a cashout kiosk 1044. Instead, a cashout ticket could be redeemed for cash by a cashier (e.g. of a convenience store), by a gaming machine or by a specially configured CVT.

Figure 11:
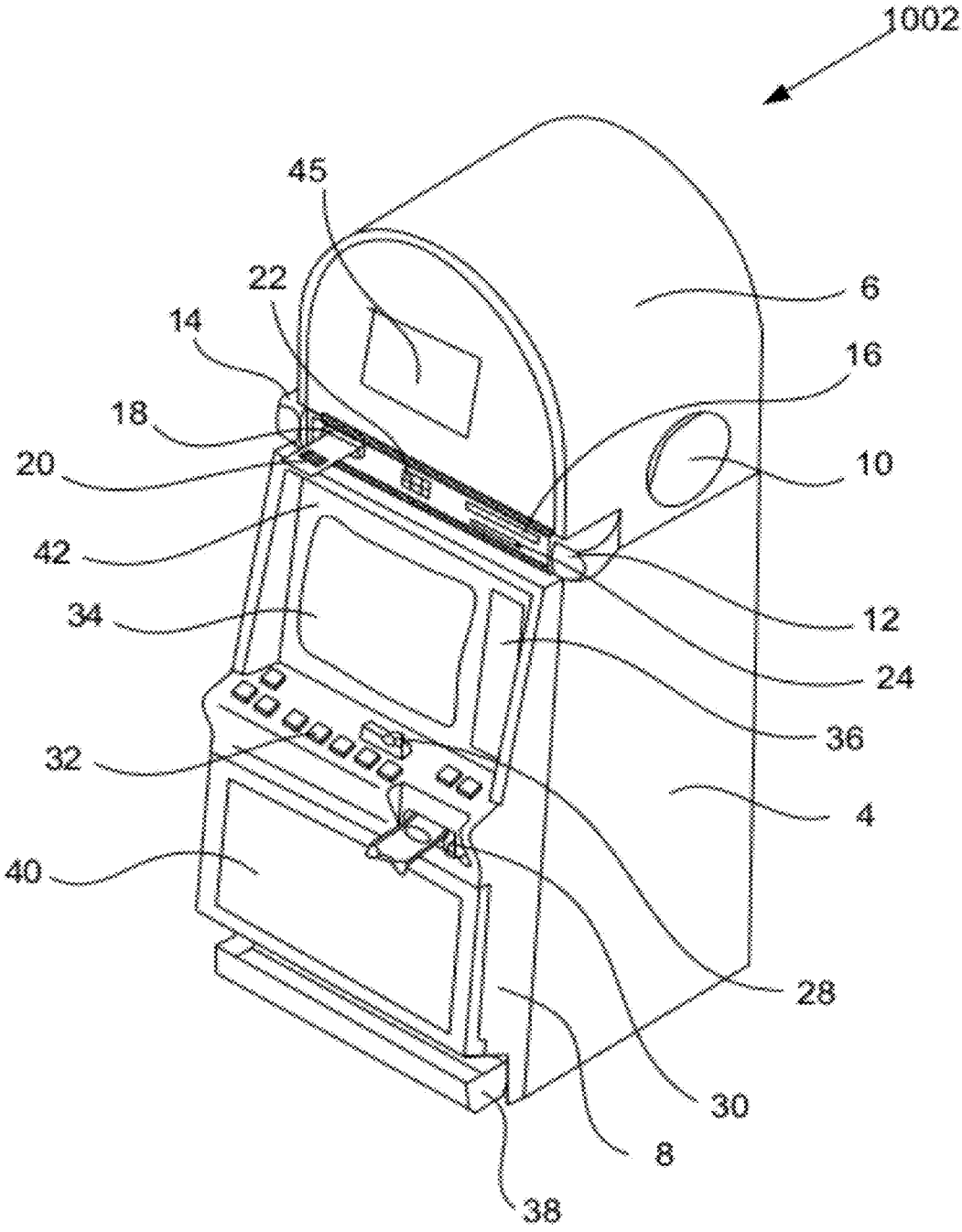
FIG. 11 illustrates an exemplary gaming machine that may be configured to implement some methods of the present invention.

Turning to FIG. 11, more details of gaming machine 1002 are described. Machine 1002 includes a main cabinet 4, which generally surrounds the machine interior (not shown) and is viewable by users. The main cabinet 4 includes a main door 8 on the front of the machine, which opens to provide access to the interior of the machine. Attached to the main door are player-input switches or buttons 32, a coin acceptor 28, and a bill validator 30, a coin tray 38, and a belly glass 40. Viewable through the main door is a video display monitor 34 and an information panel 36. The display monitor 34 will typically be a cathode ray tube, high resolution flat-panel LCD, or other conventional electronically controlled video monitor. The information panel 36 may be a back-lit, silk screened glass panel with lettering to indicate general game information including, for example, the number of coins played. The bill validator 30, player-input switches 32, video display monitor 34, and information panel are devices used to play a game on the game machine 1002. The devices are controlled by circuitry housed inside the main cabinet 4 of the machine 1002.

The gaming machine 1002 includes a top box 6, which sits on top of the main cabinet 4. The top box 6 houses a number of devices, which may be used to add features to a game being played on the gaming machine 1002, including speakers 10, 12, 14, a ticket printer 18 which may print bar-coded tickets 20 used as cashless instruments. The player tracking unit mounted within the top box 6 includes a key pad 22 for entering player tracking information, a florescent display 16 for displaying player tracking information, a card reader 24 for entering a magnetic striped card containing player tracking information, a microphone 43 for inputting voice data, a speaker 42 for projecting sounds and a light panel 44 for display various light patterns used to convey gaming information. In other embodiments, the player tracking unit and associated player tracking interface devices, such as 16, 22, 24, 42, 43 and 44, may be mounted within the main cabinet 4 of the gaming machine, on top of the gaming machine, or on the side of the main cabinet of the gaming machine.

Understand that gaming machine 1002 is but one example from a wide range of gaming machine designs on which the present invention may be implemented. For example, not all suitable gaming machines have top boxes or player tracking features. Further, some gaming machines have two or more game displays—mechanical and/or video. Some gaming machines are designed for bar tables and have displays that face upwards. Still further, some machines may be designed entirely for cashless systems. Such machines may not include such features as bill validators, coin acceptors and coin trays. Instead, they may have only ticket readers, card readers and ticket dispensers. Those of skill in the art will understand that the present can be deployed on most gaming machines now available or hereafter developed. Moreover, some aspects of the invention may be implemented on devices which lack some of the features of the gaming machines described herein, e.g., workstation, desktop computer, a portable computing device such as a personal digital assistant or similar handheld device, a cellular telephone, etc. U.S. patent application Ser. No. 09/967,326, filed Sep. 28, 2001 and entitled "Wireless Game Player," is hereby incorporated by reference for all purposes.

Returning to the example of FIG. 11, when a user wishes to play the gaming machine 1002, he or she inserts cash through the coin acceptor 28 or bill validator 30. In addition, the player may use a cashless instrument of some type to register credits on the gaming machine 1002. For example, the bill validator 30 may accept a printed ticket voucher, including 20, as an indicium of credit. As another example, the card reader 24 may accept a debit card or a smart card containing cash or credit information that may be used to register credits on the gaming machine.

During the course of a game, a player may be required to make a number of decisions. For example, a player may vary his or her wager on a particular game, select a prize for a particular game, or make game decisions regarding gaming criteria that affect the outcome of a particular game (e.g., which cards to hold). The player may make these choices using the player-input switches 32, the video display screen 34 or using some other hardware and/or software that enables a player to input information into the gaming machine (e.g. a GUI displayed on display 16).

During certain game functions and events, the gaming machine 1002 may display visual and auditory effects that can be perceived by the player. These effects add to the excitement of a game, which makes a player more likely to continue playing. Auditory effects include various sounds that are projected by the speakers 10, 12, 14. Visual effects include flashing lights, strobing lights or other patterns displayed from lights on the gaming machine 1002, from lights behind the belly glass 40 or the light panel on the player tracking unit 44.

After the player has completed a game, the player may receive game tokens from the coin tray 38 or the ticket 20 from the printer 18, which may be used for further games or to redeem a prize. Further, the player may receive a ticket 20 for food, merchandise, or games from the printer 18. The type of ticket 20 may be related to past game playing recorded by the player tracking software within the gaming machine 1002. In some embodiments, these tickets may be used by a game player to obtain game services.

IGT gaming machines are implemented with special features and/or additional circuitry that differentiates them from general-purpose computers (e.g., desktop PC's and laptops). Gaming machines are highly regulated to ensure fairness and, in many cases, gaming machines are operable to dispense monetary awards of multiple millions of dollars. Therefore, to satisfy security and regulatory requirements in a gaming environment, hardware and software architectures may be implemented in gaming machines that differ significantly from those of general-purpose computers. A description of gaming machines relative to general-purpose computing machines and some examples of the additional (or different) components and features found in gaming machines are described below.

At first glance, one might think that adapting PC technologies to the gaming industry would be a simple proposition because both PCs and gaming machines employ microprocessors that control a variety of devices. However, because of such reasons as 1) the regulatory requirements that are placed upon gaming machines, 2) the harsh environment in which gaming machines operate, 3) security requirements and 4) fault tolerance requirements, adapting PC technologies to a gaming machine can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaming machine because in a gaming machine these faults can lead to a direct loss of funds from the gaming machine, such as stolen cash or loss of revenue when the gaming machine is not operating properly.

For the purposes of illustration, a few differences between PC systems and gaming systems will be described. A first difference between gaming machines and common PC based computers systems is that gaming machines are designed to be state-based systems. In a state-based system, the system stores and maintains its current state in a non-volatile memory, such that, in the event of a power failure or other malfunction the gaming machine will return to its current state when the power is restored. For instance, if a player was shown an award for a game of chance and, before the award could be provided to the player the power failed, the gaming machine, upon the restoration of power, would return to the state where the award is indicated. As anyone who has used a PC, knows, PCs are not state machines and a majority of data is usually lost when a malfunction occurs. This requirement affects the software and hardware design on a gaming machine.

A second important difference between gaming machines and common PC based computer systems is that for regulation purposes, the software on the gaming machine used to generate the game of chance and operate the gaming machine has been designed to be static and monolithic to prevent cheating by the operator of gaming machine. For instance, one solution that has been employed in the gaming industry to prevent cheating and satisfy regulatory requirements has been to manufacture a gaming machine that can use a proprietary processor running instructions to generate the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used by the master gaming controller to operate a device during generation of the game of chance can require a new EPROM to be burnt, approved by the gaming jurisdiction and reinstalled on the gaming machine in the presence of a gaming regulator. Regardless of whether the EPROM solution is used, to gain approval in most gaming jurisdictions, a gaming machine must demonstrate sufficient safeguards that prevent an operator of a gaming machine from manipulating hardware and software in a manner that gives them an unfair and some cases an illegal advantage. The code validation requirements in the gaming industry affect both hardware and software designs on gaming machines.

A third important difference between gaming machines and common PC based computer systems is the number and kinds of peripheral devices used on a gaming machine are not as great as on PC based computer systems. Traditionally, in the gaming industry, gaming machines have been relatively simple in the sense that the number of peripheral devices and the number of functions the gaming machine has been limited. Further, in operation, the functionality of gaming machines were relatively constant once the gaming machine was deployed, i.e., new peripherals devices and new gaming software were infrequently added to the gaming machine. This differs from a PC where users will go out and buy different combinations of devices and software from different manufacturers and connect them to a PC to suit their needs depending on a desired application. Therefore, the types of devices connected to a PC may vary greatly from user to user depending in their individual requirements and may vary significantly over time.

Although the variety of devices available for a PC may be greater than on a gaming machine, gaming machines still have unique device requirements that differ from a PC, such as device security requirements not usually addressed by PCs. For instance, monetary devices, such as coin dispensers, bill validators and ticket printers and computing devices that are used to govern the input and output of cash to a gaming machine have security requirements that are not typically addressed in PCs. Therefore, many PC techniques and methods developed to facilitate device connectivity and device compatibility do not address the emphasis placed on security in the gaming industry.

To address some of the issues described above, a number of hardware/software components and architectures are utilized in gaming machines that are not typically found in general purpose computing devices, such as PCs. These hardware/software components and architectures, as described below in more detail, include but are not limited to watchdog timers, voltage monitoring systems, state-based software architecture and supporting hardware, specialized communication interfaces, security monitoring and trusted memory.

A watchdog timer is normally used in IGT gaming machines to provide a software failure detection mechanism. In a normally operating system, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits contain a loadable timeout counter register to allow the operating software to set the timeout interval within a certain range of time. A differentiating feature of the some preferred circuits is that the operating software cannot completely disable the function of the watchdog timer. In other words, the watchdog timer always functions from the time power is applied to the board.

IGT gaming computer platforms preferably use several power supply voltages to operate portions of the computer circuitry. These can be generated in a central power supply or locally on the computer board. If any of these voltages falls out of the tolerance limits of the circuitry they power, unpredictable operation of the computer may result. Though most modern general-purpose computers include voltage monitoring circuitry, these types of circuits only report voltage status to the operating software. Out of tolerance voltages can cause software malfunction, creating a potential uncontrolled condition in the gaming computer. Gaming machines of the present assignee typically have power supplies with tighter voltage margins than that required by the operating circuitry. In addition, the voltage monitoring circuitry implemented in IGT gaming computers typically has two thresholds of control. The first threshold generates a software event that can be detected by the operating software and an error condition generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the computer.

The standard method of operation for IGT slot machine game software is to use a state machine. Each function of the game (bet, play, result, etc.) is defined as a state. When a game moves from one state to another, critical data regarding the game software is stored in a custom non-volatile memory subsystem. In addition, game history information regarding previous games played, amounts wagered, and so forth also should be stored in a non-volatile memory device. This feature allows the game to recover operation to the current state of play in the event of a malfunction, loss of power, etc. This is critical to ensure the player's wager and credits are preserved. Typically, battery backed RAM devices are used to preserve this critical data. These memory devices are not used in typical general-purpose computers.

IGT gaming computers normally contain additional interfaces, including serial interfaces, to connect to specific subsystems internal and external to the slot machine. As noted above, some preferred embodiments of the present invention include parallel, digital interfaces for high-speed data transfer. However, even the serial devices may have electrical interface requirements that differ from the "standard" EIA RS232 serial interfaces provided by general-purpose computers. These interfaces may include EIA RS485, EIA RS422, Fiber Optic Serial, Optically Coupled Serial Interfaces, current loop style serial interfaces, etc. In addition, to conserve serial interfaces internally in the slot machine, serial devices may be connected in a shared, daisy-chain fashion where multiple peripheral devices are connected to a single serial channel.

IGT Gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this.

Security monitoring circuits detect intrusion into an IGT gaming machine by monitoring security switches attached to access doors in the slot machine cabinet. Preferably, access violations result in suspension of game play and can trigger additional security operations to preserve the current state of game play. These circuits also function when power is off by use of a battery backup. In power-off operation, these circuits continue to monitor the access doors of the slot machine. When power is restored, the gaming machine can determine whether any security violations occurred while power was off, e.g., via software for reading status registers. This can trigger event log entries and further data authentication operations by the slot machine software.

Trusted memory devices are preferably included in an IGT gaming machine computer to ensure the authenticity of the software that may be stored on less secure memory subsystems, such as mass storage devices. Trusted memory devices and controlling circuitry are typically designed to not allow modification of the code and data stored in the memory device while the memory device is installed in the slot machine. The code and data stored in these devices may include authentication algorithms, random number generators, authentication keys, operating system kernels, etc. The purpose of these trusted memory devices is to provide gaming regulatory authorities a root trusted authority within the computing environment of the slot machine that can be tracked and verified as original. This may be accomplished via removal of the trusted memory device from the slot machine computer and verification of the trusted memory device contents in a separate third party verification device. Once the trusted memory device is verified as authentic, and based on the approval of the verification algorithms contained in the trusted device, the gaming machine is allowed to verify the authenticity of additional code and data that may be located in the gaming computer assembly, such as code and data stored on hard disk drives.

Mass storage devices used in a general purpose computer typically allow code and data to be read from and written to the mass storage device. In a gaming machine environment, modification of the gaming code stored on a mass storage device is strictly controlled and would only be allowed under specific maintenance type events with electronic and physical enablers required. Though this level of security could be provided by software, IGT gaming computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present.

Gaming machines used for Class III games generally include software and/or hardware for generating random numbers. However, gaming machines used for Class II games may or may not have RNG capabilities. In some machines used for Class II games, RNG capability may be disabled.

Figure 12:
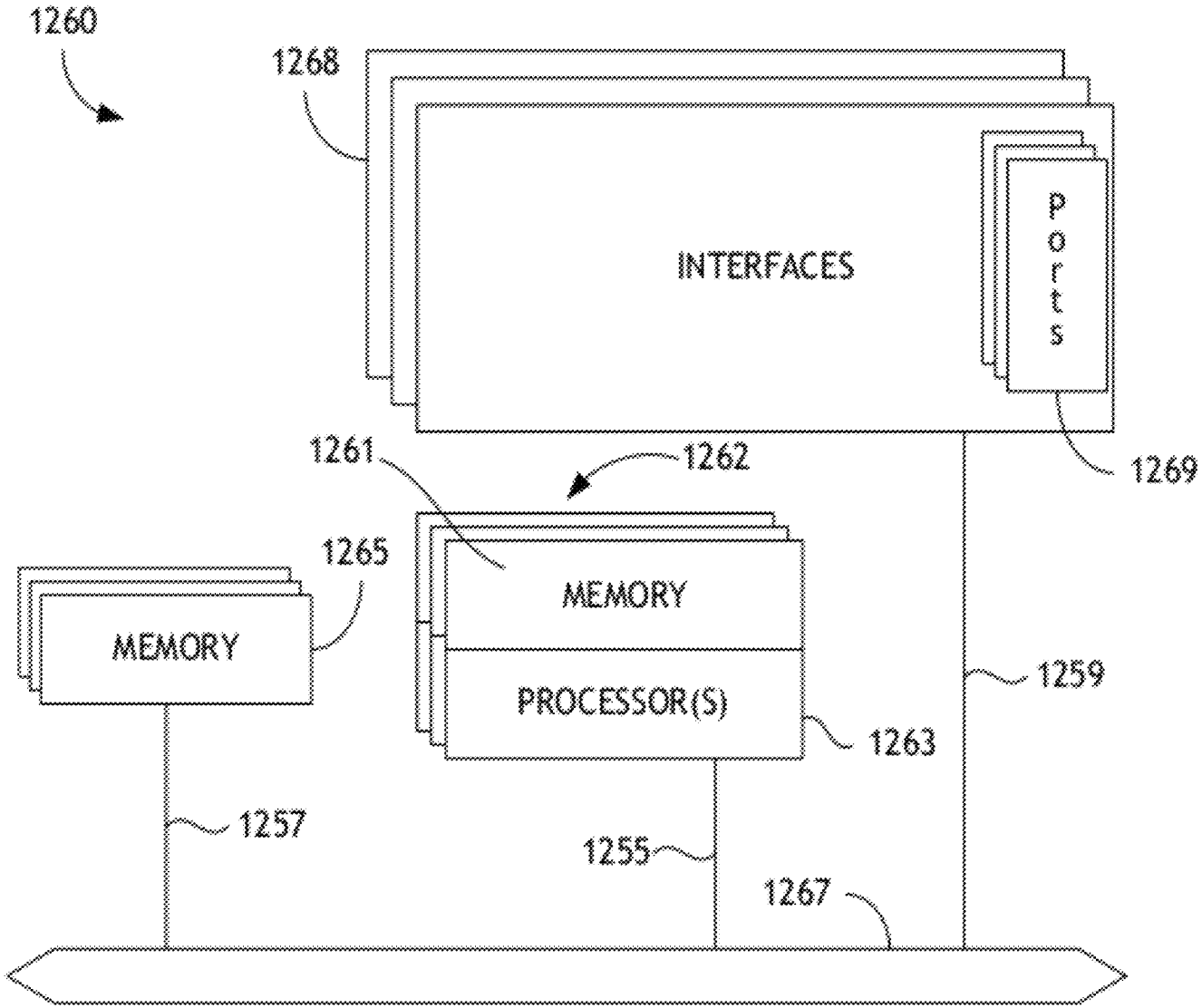
FIG. 12 is a block diagram of an exemplary network device that may be configured as a game server to implement some methods of the present invention.

FIG. 12 illustrates an example of a network device that may be configured as a game server for implementing some methods of the present invention. Network device 1260 includes a master central processing unit (CPU) 1262, interfaces 1268, and a bus 1267 (e.g., a PCI bus). Generally, interfaces 1268 include ports 1269 appropriate for communication with the appropriate media. In some embodiments, one or more of interfaces 1268 includes at least one independent processor and, in some instances, volatile RAM. The independent processors may be, for example, ASICs or any other appropriate processors. According to some such embodiments, these independent processors perform at least some of the functions of the logic described herein. In some embodiments, one or more of interfaces 1268 control such communications-intensive tasks as media control and management. By providing separate processors for the communications-intensive tasks, interfaces 1268 allow the master microprocessor 1262 efficiently to perform other functions such as routing computations, network diagnostics, security functions, etc.

The interfaces 1268 are typically provided as interface cards (sometimes referred to as "linecards"). Generally, interfaces 1268 control the sending and receiving of data packets over the network and sometimes support other peripherals used with the network device 1260. Among the interfaces that may be provided are FC interfaces, Ethernet interfaces, frame relay interfaces, cable interfaces, DSL interfaces, token ring interfaces, and the like. In addition, various very high-speed interfaces may be provided, such as fast Ethernet interfaces, Gigabit Ethernet interfaces, ATM interfaces, HSSI interfaces, POS interfaces, FDDI interfaces, ASI interfaces, DHEI interfaces and the like.

When acting under the control of appropriate software or firmware, in some implementations of the invention CPU 1262 may be responsible for implementing specific functions associated with the functions of a desired network device. According to some embodiments, CPU 1262 accomplishes all these functions under the control of software including an operating system and any appropriate applications software.

CPU 1262 may include one or more processors 1263 such as a processor from the Motorola family of microprocessors or the MIPS family of microprocessors. In an alternative embodiment, processor 1263 is specially designed hardware for controlling the operations of network device 1260. In a specific embodiment, a memory 1261 (such as non-volatile RAM and/or ROM) also forms part of CPU 1262. However, there are many different ways in which memory could be coupled to the system. Memory block 1261 may be used for a variety of purposes such as, for example, caching and/or storing data, programming instructions, etc.

Regardless of network device's configuration, it may employ one or more memories or memory modules (such as, for example, memory block 1265) configured to store data, program instructions for the general-purpose network operations and/or other information relating to the functionality of the techniques described herein. The program instructions may control the operation of an operating system and/or one or more applications, for example.

Because such information and program instructions may be employed to implement the systems/methods described herein, the present invention relates to machine-readable media that include program instructions, state information, etc. for performing various operations described herein. Examples of machine-readable media include, but are not limited to, magnetic media such as hard disks, floppy disks, and magnetic tape; optical media such as CD-ROM disks; magneto-optical media; and hardware devices that are specially configured to store and perform program instructions, such as read-only memory devices (ROM) and random access memory (RAM). The invention may also be embodied in a carrier wave traveling over an appropriate medium such as airwaves, optical lines, electric lines, etc. Examples of program instructions include both machine code, such as produced by a compiler, and files containing higher level code that may be executed by the computer using an interpreter.

Although the system shown in FIG. 12 illustrates one specific network device of the present invention, it is by no means the only network device architecture on which the present invention can be implemented. For example, an architecture having a single processor that handles communications as well as routing computations, etc. is often used. Further, other types of interfaces and media could also be used with the network device. The communication path between interfaces may be bus based (as shown in FIG. 12) or switch fabric based (such as a cross-bar).

The above-described devices and materials will be familiar to those of skill in the computer hardware and software arts. Although many of the components and processes are described above in the singular for convenience, it will be appreciated by one of skill in the art that multiple components and repeated processes can also be used to practice the techniques of the present invention.

Although the foregoing invention has been described in some detail for purposes of clarity of understanding, it will be apparent that certain changes and modifications may be practiced within the scope of the appended claims. For example, alternative implementations do not cause cards corresponding to undaubed numbers to be "slept" for the purposes of determining a hand of cards. In alternative implementations, the draw for the game takes place before the players know the arrangements on their Bingo cards. Some such implementations involve exposing previously purchased Bingo cards.

Some implementations of the invention allow a player to view one or more draw cards prior to determining which cards to hold. In some such implementations, the player may view the first draw card for a fee, the first two draw cards for a higher fee, and so on. In exchange for a fee, some implementations allow a player to select draw cards out of the normal sequence. For example, if a player paid to see the first two draw cards, the player could choose the second draw card but not the first draw card. In preferred implementations, the possible interim win payouts to the player are reduced if the player chooses to view one or more draw cards in advance.

The invention claimed is:

1. A method of providing an electronic bingo game via a plurality of gaming machines, the method comprising:

drawing a first set of bingo numbers;

drawing a second set of bingo numbers;

causing each gaming machine of the plurality of gaming machines to:

display a bingo card, the bingo card including a plurality of bingo numbers, display information indicating a winning bingo pattern associated with the bingo card, display face values for a first hand of playing cards, each playing card in the first hand corresponding to a bingo number in the plurality of bingo numbers included on the bingo card and the number of playing cards in the first hand being equal to a first amount, permit bingo numbers on the bingo card corresponding to the bingo numbers in the first set of bingo numbers to be daubed during a first time, wherein each playing card in the first hand of playing cards further corresponds to a daubed bingo number on the bingo card, receive input indicating selected playing cards in the first hand, display a face value for an additional playing card for each unselected playing card in the first hand, thereby forming a second hand of playing cards composed of the selected playing cards in the first hand and, if present, the additional playing cards, permit bingo numbers on the bingo card corresponding to the bingo numbers in the second set of bingo numbers to be daubed during a second time, wherein each additional playing card in the second hand of playing cards further corresponds to a daubed bingo number on the bingo card, and determining, after the second hands have been formed, the gaming machine or gaming machines in the plurality of gaming machines that display the highest-ranked poker hand with respect to the second hand of playing cards, wherein:

the drawing the first set of bingo numbers includes drawing bingo numbers until the winning bingo pattern is daubed on the bingo card of one or more of the gaming machines in the plurality of gaming machines, and the first hand of playing cards is displayed only after the second set of bingo numbers is drawn when one or more of the gaming machines has less bingo numbers daubed during the first time than the first amount after drawing the first set of bingo numbers.

2. The method of claim 1, the method furthering comprising:

drawing a quantity of bingo balls at least greater than or equal to the first amount; and causing each gaming machine of the plurality of gaming machines to determine which playing cards are to be included in the first hand or the second hand based on the sequence in which the daubed bingo numbers were drawn.

3. The method of claim 1, the method further comprising causing each gaming machine of the plurality of gaming machines to automatically daub bingo numbers on the bingo card corresponding to drawn bingo numbers.

4. The method of claim 1, wherein the winning bingo pattern may be daubed on a first gaming machine of the plurality of gaming machines, and the highest-ranked poker hand may be displayed on a second gaming machine or gaming machines of the plurality of gaming machines, wherein the first gaming machine is not the second gaming machine or gaming machines.

5. The method of claim 1, wherein the second hand of playing cards is the same as the first hand of playing cards when all playing cards in the first hand of playing cards are selected.

6. A gaming machine comprising:

a display device;

an input device;

a network communications interface; and a master gaming controller operably connected with the network communications interface, the input device, and the display device, the master gaming controller configured to:

receive information indicating a first set of drawn bingo numbers, receive information indicating a second set of drawn bingo numbers, control the display device to:

(i) display a bingo card, the bingo card including a plurality of bingo numbers, (ii) display information indicating a winning bingo pattern associated with the bingo card, and (iii) display face values for a first hand of playing cards, each playing card in the first hand corresponding to a bingo number in the plurality of bingo numbers included on the bingo card and the number of playing cards in the first hand being equal to a first amount, permit bingo numbers on the bingo card corresponding to the bingo numbers in the first set of drawn bingo numbers to be daubed during a first time, wherein each playing card in the first hand of playing cards further corresponds to a daubed bingo number on the bingo card, receive input indicating selected playing cards in the first hand, and further control the display device to display a face value for an additional playing card for each unselected playing card in the first hand, thereby forming a second hand of playing cards composed of the selected playing cards in the first hand and, if present, the additional playing cards, permit bingo numbers on the bingo card corresponding to the bingo numbers in the second set of drawn bingo numbers to be daubed during a second time, wherein each additional playing card in the second hand of playing cards further corresponds to a daubed bingo number on the bingo card, further control the display device to display the first hand of cards only after the information indicating the second set of drawn bingo numbers is received when the gaming machine or one or more of the other similarly-configured gaming machines has less bingo numbers daubed during the first time than the first amount after drawing the first set of bingo numbers, and receive information, via the network communications interface, indicating whether or not second hands displayed on other similarly-configured gaming machines rank higher than the second hand displayed on the display device of the gaming machine.

7. The gaming machine of claim 6, wherein the master gaming controller is further configured to determine which playing cards are to be included in the first hand or the second hand based on the sequence in which the daubed bingo numbers were drawn.

8. The gaming machine of claim 6, wherein the master gaming controller is further configured to automatically daub bingo numbers on the bingo card corresponding to drawn bingo numbers.

9. The gaming machine of claim 6, wherein the second hand of playing cards is the same as the first hand of playing cards when all playing cards in the first hand of playing cards are determined to be selected.

10. A wager gaming system comprising a plurality of gaming machines and a game server connected via a gaming network, the game server configured to:

draw a first set of bingo numbers, and draw a second set of bingo numbers; and each gaming machine configured to:

display a bingo card, the bingo card including a plurality of bingo numbers, display information indicating a winning bingo pattern associated with the bingo card, display face values for a first hand of playing cards, each playing card in the first hand corresponding to a bingo number in the plurality of bingo numbers included on the bingo card and the number of playing cards in the first hand being equal to a first amount, permit bingo numbers on the bingo card corresponding to the bingo numbers in the first set of bingo numbers to be daubed during a first time, wherein each playing card in the first hand of playing cards further corresponds to a daubed bingo number on the bingo card, receive input indicating selected playing cards in the first hand, display a face value for an additional playing card for each unselected playing card in the first hand, thereby forming a second hand of playing cards composed of the selected playing cards in the first hand and, if present, the additional playing cards permit bingo numbers on the bingo card corresponding to the bingo numbers in the second set of bingo numbers to be daubed during a second time, wherein each additional playing card in the second hand of playing cards further corresponds to a daubed bingo number on the bingo card, and receive information, via the gaming network, indicating whether or not the second hand, with respect to second hands of the other gaming machines in the plurality of gaming machines, is a highest-ranked hand of playing cards, wherein:

the game server is further configured to draw bingo numbers until the winning bingo pattern is daubed on the bingo card of one or more of the gaming machines in the plurality of gaming machines, and the gaming machines are further configured to display the first hand of playing cards only after the second set of bingo numbers is drawn when one or more of the gaming machines has less bingo numbers daubed during the first time than the first amount after the first set of bingo numbers is drawn.

11. The wager gaming system of claim 10, wherein the game server is further configured to draw bingo numbers for the first set of bingo numbers until the winning bingo pattern is daubed on the bingo card of one or more of the gaming machines in the plurality of gaming machines.

12. The wager gaming system of claim 10, the system further comprising a game server, wherein:

the game server is configured to draw a quantity of bingo balls greater than or equal to the first amount; and each gaming machine is further configured to determine which playing cards are to be included in the first hand or the second hand based on the sequence in which the daubed bingo numbers were drawn.

13. The wager gaming system of claim 10, wherein each gaming machine is further configured to automatically daub bingo numbers on the bingo card corresponding to drawn bingo numbers.

14. The wager gaming system of claim 10, wherein the winning bingo pattern may be daubed on a first gaming machine of the plurality of gaming machines, and the highest-ranked poker hand may be displayed on a second gaming machine or gaming machines of the plurality of gaming machines, wherein the first gaming machine is not the second gaming machine or gaming machines.

15. The wager gaming system of claim 10, wherein, for a wager gaming machine of the wager gaming machines, the second hand of playing cards is the same as the first hand of playing cards when all playing cards in the first hand of playing cards are selected.

* * * * *